US009670705B2

(12) United States Patent
Liang et al.

(10) Patent No.: US 9,670,705 B2
(45) **Date of Patent: *Jun. 6, 2017**

(54) CASEMENT WINDOW OPENING CONTROL DEVICE

(71) Applicant: Vision Industries Group, Inc., So. Plainfield, NJ (US)

(72) Inventors: Luke Liang, So. Plainfield, NJ (US); Tong Liang, Guangzhou (CN); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/176,420

(22) Filed: Jun. 8, 2016

(65) Prior Publication Data

US 2016/0340945 A1 Nov. 24, 2016

Related U.S. Application Data

(63) Continuation of application No. 14/747,155, filed on Jun. 23, 2015, now Pat. No. 9,388,612, which is a (Continued)

(51) Int. Cl.
*E05C 17/02* (2006.01)
*E05B 65/10* (2006.01)
(Continued)

(52) U.S. Cl.
CPC ..... *E05C 17/02* (2013.01); *E05B 65/0014* (2013.01); *E05B 65/1033* (2013.01);
(Continued)

(58) Field of Classification Search
CPC .. E05C 17/02; E05C 17/34; E05F 5/00; E05F 11/18; E05F 11/20; E05F 11/24;
(Continued)

(56) References Cited

U.S. PATENT DOCUMENTS 597,219 A * 1/1898 Pettingell ..... E05C 17/32 292/263
3,278,213 A * 10/1966 March ..... E05C 17/32 292/263
(Continued)

FOREIGN PATENT DOCUMENTS

| | | |
|---|---|---|
| GB | 2262565 | 6/1993 |
| GB | 2391901 | 2/2004 |
| GB | 2407116 | 4/2005 |

*Primary Examiner* — Katherine Mitchell
*Assistant Examiner* — Marcus Menezes
(74) *Attorney, Agent, or Firm* — Thomas A. O'Rourke; Bodner & O'Rourke, LLP

(57) ABSTRACT

A device may limit opening of a sash hingedly coupled to a master frame, and includes: a bracket attached to the sash; a first arm having a first end pivotally coupled to the bracket; a second arm having a first end pivotally coupled to the first arm's second end; means for biasing the second arm into a retracted position; and a release assembly. The release assembly is secured to the master frame and includes a hook pivotable between a first position and a second position, which, in the first position, may be releasably received in an opening in the second end of the second arm when the second arm is in the retracted position, as the sash is closed and received within the master window frame The second arm is disengaged from the hook, permitting full opening of the sash, when the hook is pivoted into the second position.

4 Claims, 31 Drawing Sheets

Related U.S. Application Data continuation of application No. 14/043,043, filed on Oct. 1, 2013, now Pat. No. 9,115,529.

(51) Int. Cl.

| | |
|---|---|
| ***E06B 3/34*** | (2006.01) |
| ***E06B 5/10*** | (2006.01) |
| ***E05C 21/00*** | (2006.01) |
| ***E05B 65/00*** | (2006.01) |
| ***E05F 11/16*** | (2006.01) |
| ***E05F 5/00*** | (2017.01) |
| ***E06B 1/36*** | (2006.01) |
| ***E06B 3/32*** | (2006.01) |
| ***E06B 3/36*** | (2006.01) |
| ***E05C 17/34*** | (2006.01) |
| *E05B 15/04* | (2006.01) |

(52) U.S. Cl.

CPC ..... *E05C 17/34* (2013.01); *E05C 21/00* (2013.01); *E05F 5/00* (2013.01); *E05F 11/16* (2013.01); *E06B 1/36* (2013.01); *E06B 3/325* (2013.01); *E06B 3/34* (2013.01); *E06B 3/36* (2013.01); *E06B 5/10* (2013.01); *E05B 2015/0406* (2013.01); *E05Y 2201/21* (2013.01); *E05Y 2800/40* (2013.01); *E05Y 2900/148* (2013.01)

(58) Field of Classification Search

CPC .. E05F 11/16; E06B 3/325; E06B 3/36; E05B 65/0014; E05B 65/1033

See application file for complete search history.

(56) References Cited

U.S. PATENT DOCUMENTS

| | | | | |
|---|---|---|---|---|
| 4,943,104 | A * | 7/1990 | Zani | B60J 7/057 292/263 |
| 5,090,754 | A * | 2/1992 | Thompson | E05C 17/32 292/262 |
| 5,802,768 | A * | 9/1998 | Hammer | E05F 15/619 403/345 |
| 8,418,404 | B2 * | 4/2013 | Gramstad | E05C 17/24 49/141 |
| 8,726,572 | B2 * | 5/2014 | Derham | E05C 19/003 49/141 |
| 8,813,424 | B2 * | 8/2014 | Nguyen | E05C 17/24 16/364 |
| 2011/0067246 | A1 | 3/2011 | Perez | |
| 2011/0173895 | A1 | 7/2011 | Lund | |
| 2011/0203184 | A1 | 8/2011 | Nguyen | |
| 2012/0036781 | A1 | 2/2012 | Runk | |

* cited by examiner

CASEMENT WINDOW OPENING CONTROL DEVICE

CROSS REFERENCES TO RELATED APPLICATIONS

This application in a continuation of U.S. application Ser. No. 14/747,155, filed on Jun. 23, 2015, which is a continuation of U.S. application Ser. No. 14/043,043, filed on Oct. 1, 2013, now issued as U.S. Pat. No. 9,115,529, all disclosures of which are incorporated herein by reference.

FIELD OF THE INVENTION

The present invention relates to improvements in window opening control devices, and more particularly to a device that is capable of limiting the travel of a casement window.

BACKGROUND OF THE INVENTION

One safety concern for children, with respect to the windows that may be installed into residential homes and other buildings, are its features that may serve to prevent accidental egress and serious injury from a fall. One preventative feature is the height that the windows are installed above the floor, which prevents toddlers from accidentally falling out, and inhibits small children from creatively seeking to observe the outside view from the sill of the window, which could result in an accidental fall therefrom.

Opening control devices for windows (WOCDs), which serve to releasably limit the travel that a window may undergo to a relatively small amount, which may be roughly four inches, are another feature that has been employed on sliding sash windows for that reason. They have also been utilized thereon to prevent unauthorized entry into the dwelling from the outside by an intruder. However, preventative measures in the form of WOCDs have not been pursued as vigorously for casement windows, which typically are hingedly connected in some fashion to the master window frame.

As building codes have sought to regulate the construction industry to improve child safety through the use of such devices (see e.g., ASTM F2090-10: "Standard Specification for Window Fall Prevention Devices with Emergency Escape (Egress) Release Mechanisms"), tradeoffs have been proposed to reduce the height restrictions for window installations where such devices are utilized. But such lessening of these window height requirements only serves to place greater importance on the integrity of the WOCDs, particularly their ability to automatically reset themselves, after having been manually released to open the casement window beyond its restricted range of movement.

The window opening control device of the present invention is uniquely adapted to not only limit the range of travel of the casement window to prevent accidental falls therefrom, and to automatically reset itself, but to also avoid the necessity of having to remove the screen from the window in order for the device to function properly.

Objects of the Invention

It is an object of the invention to provide a window opening control device that may releasably limit the travel of a casement window to an amount preventing accidental egress therefrom.

It is another object of the invention to provide a window opening control device for a casement window that is easily released to permit full travel of the casement window when desired.

It is a further object of the invention to provide a safety switch for a window opening control device for a casement window that prevents tampering by young children who may seek to impermissibly operate the safety device.

It is another object of the invention to provide a window opening control device for a casement window that automatically resets the device, after the window has been moved back to the closed position.

Further objects and advantages of the invention will become apparent from the following description and claims, and from the accompanying drawings.

SUMMARY OF THE INVENTION

A device may limit opening of a sash window that is hingedly coupled to a master window frame, and may include: a bracket attached to the sash; a first arm having a first end pivotally coupled to the bracket; a second arm having a first end pivotally coupled to the second end of the first arm; a means for biasing the second arm into a retracted position; and a release assembly. The release assembly may be secured within the master window frame and may include a hook member that is pivotable between a first position and a second position.

With the hook member occupying the first position, the hook portion thereon may be releasably received in an opening in the second end of the second arm, when the first and second arms are in the retracted position, and the sash is closed and received by the master window frame.

The first arm may normally occupy its retracted position, with respect to the bracket that is fixedly secured to the sash, by rotating downward into a vertically oriented position, and may be limited to that position through the prevention of any over-travel by a stop protruding from the bracket. The second arm may be configured to normally occupy its retracted position, with respect to the vertically oriented first arm and the bracket, by being biased against gravity to rotate upwardly to be positioned, and travel limited by a stop on the first arm, to occupy a somewhat vertical position, being at a small acute angle with respect to the first arm.

Once the hook portion of the hook member has been releasably received within the opening in the second end of the second arm, as described above, the sash may be opened, and the amount that it may be opened will be travel-limited according to the length of the first and second arms. The sash of the casement window being travel limited in this manner will prevent a small child from accidentally falling through the gap between the sash and the master window frame. When the user desires to open the window even further, the second arm may be disengaged from the hook of the release assembly, by rotating the hook to be in the second position.

The hook may be configured to extend from a graspable switch member, in order for a user's hand to more easily cause its pivotal movement between the first and second positions. The hook and switch member may be installed directly into a master window frame that is particularly configured to receive its envelope and permit pivotal movement therein, or it may instead be received within a base member that itself is adapted to be received within a simple opening in the master window frame and secured thereat.

The combination of the switch member and base member may serve to enable additional functionality. The switch member may be configured to receive a spring biased safety button therein, which may be slidable between a protruding position and a depressed position. The safety button may be configured to inhibit pivoting of the switch member and hook combination from its first position, when the button occupies its spring biased outwardly disposed position. When the button is depressed, pivoting of the switch member is no longer inhibited, and it may be pivoted into the second position to release the second arm from the hook member. The helical spring may also have its ends adapted to provide torsional biasing of the switch member relative to the base member, so that when the user releases their grasp of the switch member, it may be biased so that the combination switch member and hook member occupy the first position, and may readily accommodate engagement with the catch assembly.

DETAILED DESCRIPTION OF THE INVENTION

Figure 1:
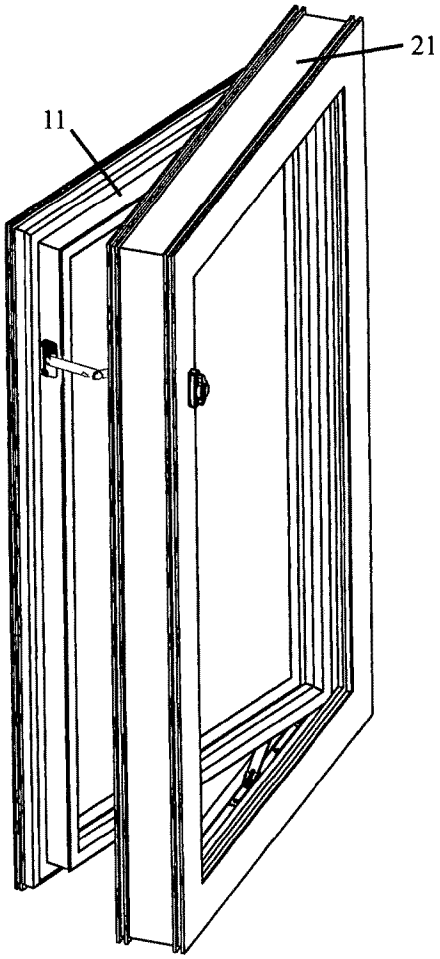
FIG. 1 illustrates a perspective view of the window opening control device of the present invention, installed upon a casement window master frame and its sash window, and with the device being used to releasably secure the window sash to prevent further travel of the opened window beyond the safe limit.
Figure 2:
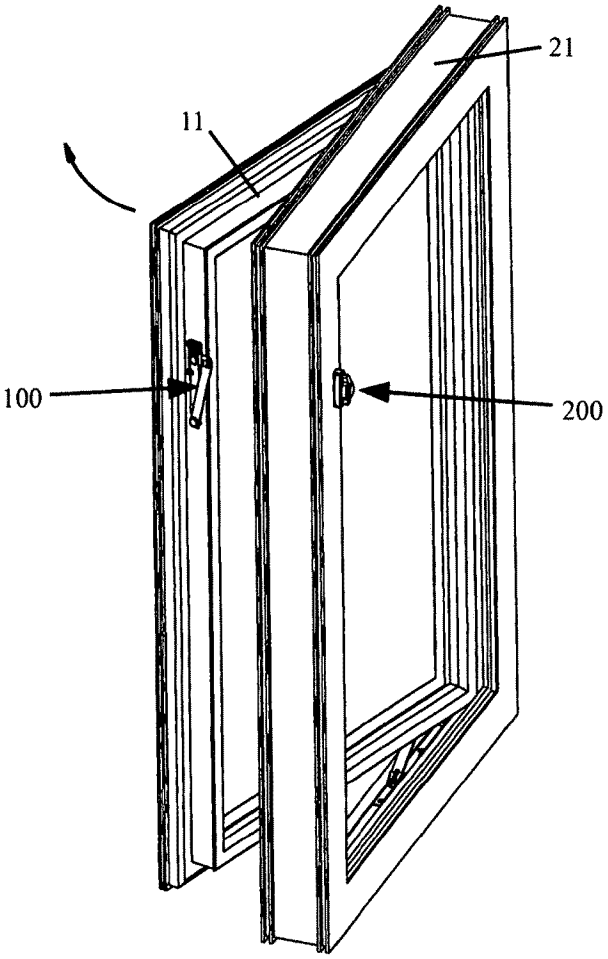
FIG. 2 illustrates the window opening control device and casement window of FIG. 1, but with the device having been released to permit further travel of the opened window sash.

FIG. 1 illustrates a perspective view of the catch assembly of the window opening control device of the present invention having been installed upon a master frame and sash of a casement window. The device is being used thereon to releasably secure the sash to the master frame to prevent further travel of the opened window sash beyond the safe limit. Depressing of a safety button and pivoting of a switch member causes release of the device to permit further travel of the opened window sash, as seen in FIG. 2.

Figure 2A:
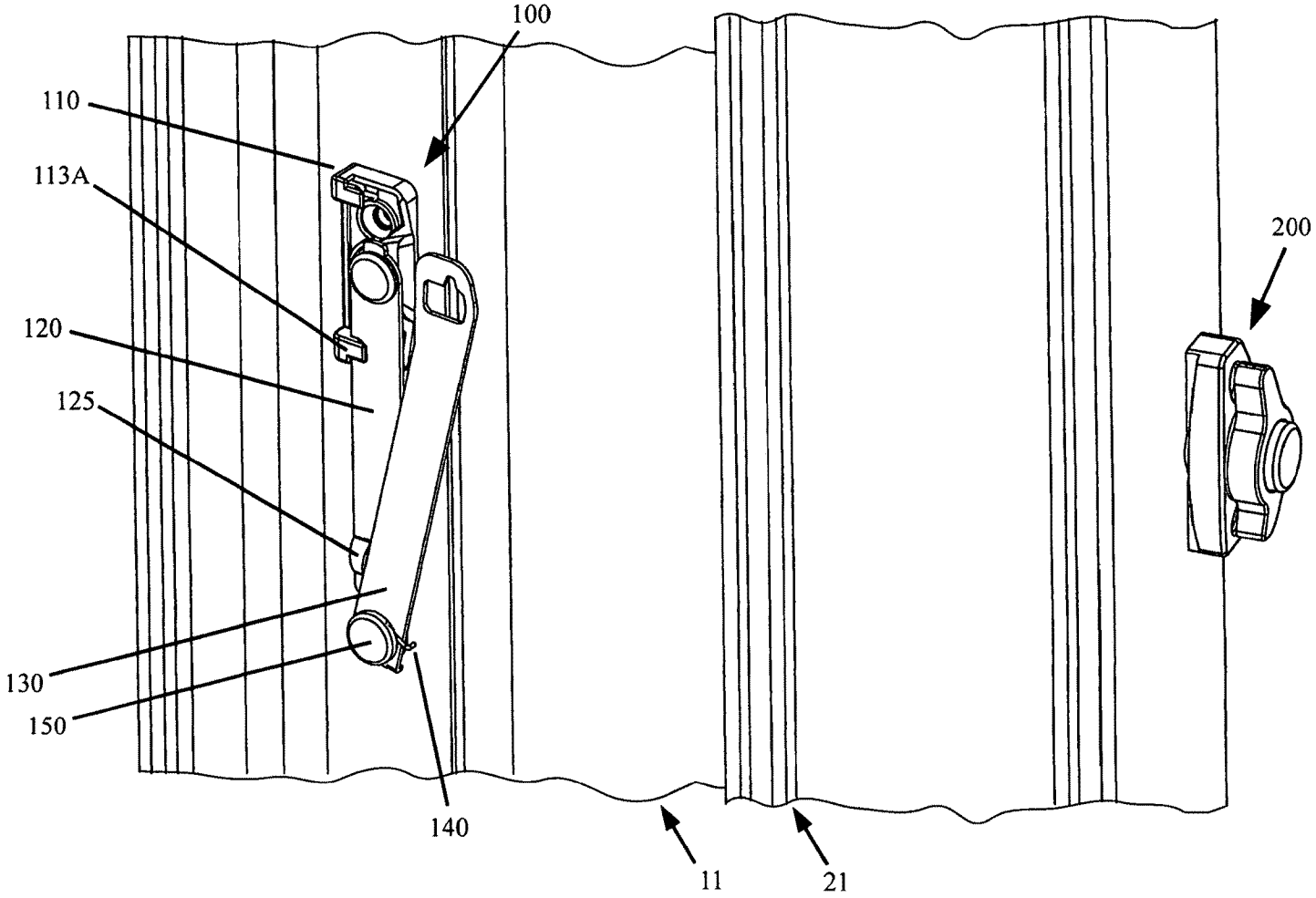
FIG. 2A is an enlarged detail view of the release assembly on the window frame and the catch assembly on the sash, as seen in perspective view of FIG. 1.

The two main assemblies of the opening control device of the present invention are seen in the enlarged detail view of FIG. 2A, and consist of the catch assembly 100, and the release assembly 200. The catch assembly 100 and release assembly 200 may be secured to the sash window 11 and the master window frame 21, respectively, and are discussed further hereinafter.

Figure 8:
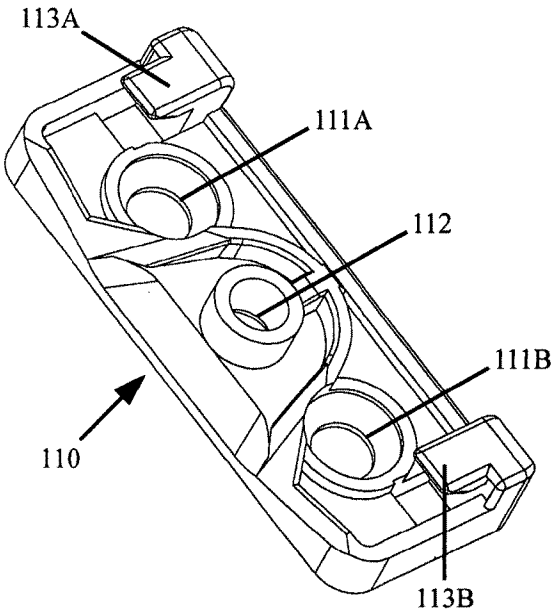
FIG. 8 is a perspective view of the bracket of the catch assembly of the opening control device of the present invention.
Figure 8C:
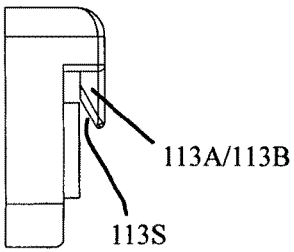
FIG. 8C is an end view of the bracket of the catch assembly of FIG. 8.
Figure 8B:
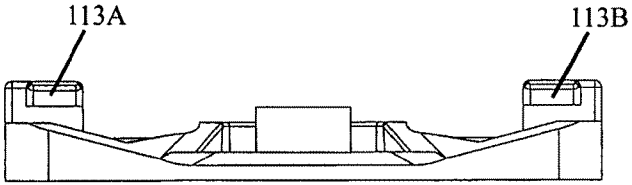
FIG. 8B is a side view of the bracket of the catch assembly of FIG. 8.
Figure 8A:
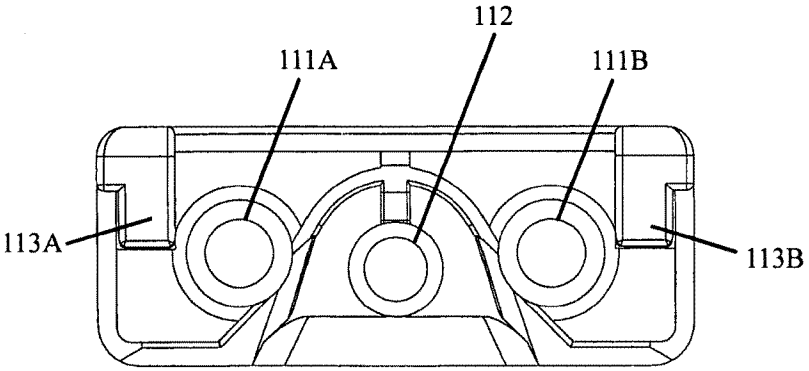
FIG. 8A is a front view of the bracket of the catch assembly of FIG. 8.

The catch assembly 100 may consist of a bracket 110, a first arm 120, a second arm 130, and a torsion spring 140. The bracket 110 is shown in detail within FIGS. 8-8C. Bracket 110 may be a generally flat plate that may be pocketed to reduce weight in-between certain features that are necessary to enable use of the bracket. Bracket 110 may include a pair of mounting holes 111A and 111B, which may be formed with a countersink to accommodate flush head mounting screws therein, in order to suitably mount the bracket to the side of the sash 11. A hole 112 in the bracket 110 may be used for pivotal mounting thereto of the first arm 120, which may be pivotally mounted using a rivet 159, or other suitable pivotal fastening means. The bracket 110 may include a protruding stop member thereon, which may be used to limit travel of the pivotally mounted first arm 120 with respect to the bracket, when the arm is in the retracted position. The mounting holes 111A and 111B may be symmetrically positioned in the bracket, and may be symmetrically positioned with respect to the hole 112 that is used for pivotal mounting of the first arm 120, which may be centered therein. With the hole 112 being centrally positioned, the pivotal stop may be located towards one end of the bracket 110, to reduce loading of those features of the bracket. In order to be able to use the bracket for mounting to either a left-hand or a right-hand sash of the casement window, there may be a first pivotal stop 113A located at one end of the bracket 110, and a second pivotal stop 113B located at the other end of the bracket. Each of the stops 113A and 113B of bracket 110 of the catch assembly 100 may have a "V" shaped cavity formed by a slanted surface 113S (FIG. 8) of the stop, which works for guiding automatic alignment of the first arm 120 when the catch assembly 100 is biased back towards the sash 11, and thereafter the stop 113 completely inhibits further rotation of the first arm 120 at the fully retracted position with respect to bracket 110.

Figure 9:
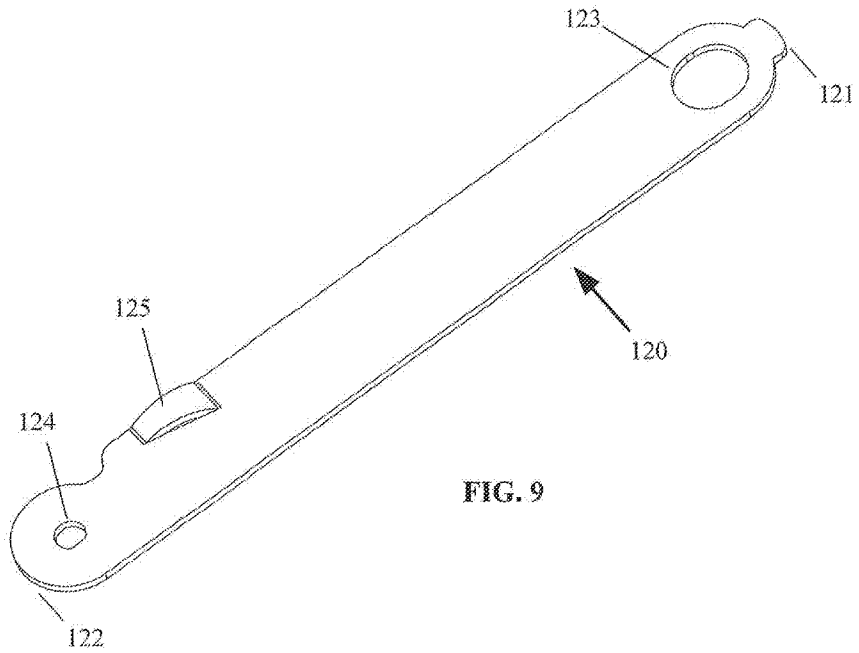
FIG. 9 is a perspective view of the first arm of the catch assembly of the opening control device of the present invention.
Figure 9B:
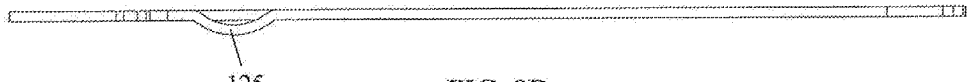
FIG. 9B is a side view of the first arm of the catch assembly of FIG. 9.
Figure 9A:
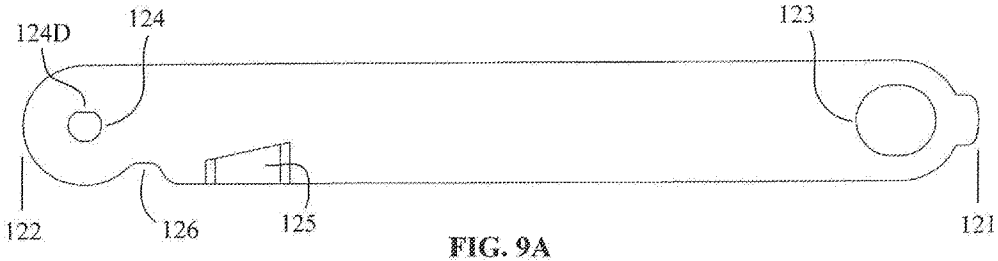
FIG. 9A is a front view of the first arm of the catch assembly of FIG. 9.
Figure 9C:
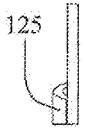
FIG. 9C is an end view of the first arm of the catch assembly of FIG. 9.

The first arm 120 is shown in detail in FIGS. 9-9C, and may be an elongated thin plate member, which may be formed of plastic, metal, or any other suitable material. Proximate to the first end 121 of the arm 120 may be a hole 123 usable for pivotal mounting of the arm to the hole 112 of bracket 110. Hole 123 may be an eccentric or slotted hole, through which the first arm 120 is riveted with the bracket 110 of catch assembly 100 via the rivet 159. It provides free movements of the first arm 120 in all directions when the first arm 120 retracts to the sash 11 when the catch assembly 100 is unlocked from the release member 200. Proximate to the second end 122 of the first arm 120 may be a hole 124 for the pivotal mounting thereto of the second arm 130. Also proximate to the second end 122 may be a recess 126 in the side of the plate, which may be generally flat at a central portion. The first arm 120 may have a stop 125 positioned thereon to be in proximity to hole 124. The stop could simply be a mechanical fastener that is fastened to the plate, such as a rivet or a nut and bolt. Alternatively, the stop could be a protrusion that is integral with the plate or bonded thereto, or the stop could be a portion of the plate being stamped and raised to protrude beyond the flat plane of one side of the arm. The latter option is shown in FIG. 9A, which may be seen to produce a straight edge for the stop that may generally be aligned with the position of the edge of the second arm 130 where it is to be restrained in the retracted position.

Figure 10:
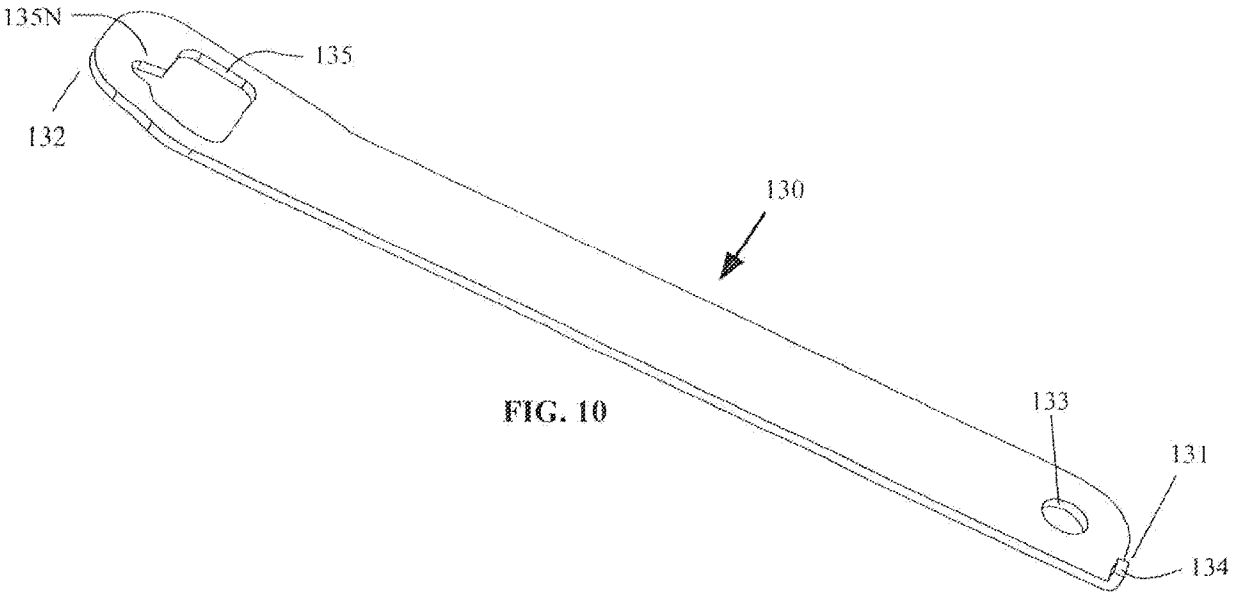
FIG. 10 is a perspective view of the second arm of the catch assembly of the opening control device of the present invention.
Figure 10B:
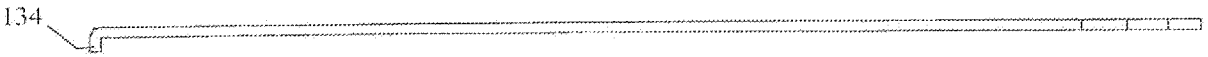
FIG. 10B is a side view of the second arm of the catch assembly of FIG. 10.
Figure 10A:
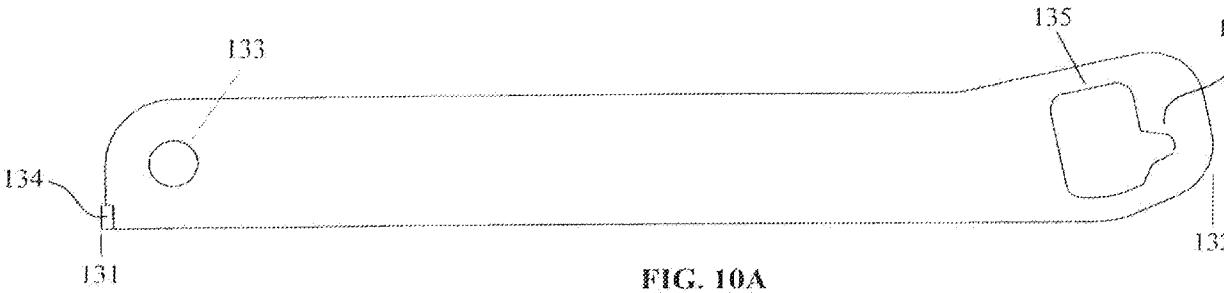
FIG. 10A is a front view of the second arm of the catch assembly of FIG. 10.
Figure 10C:
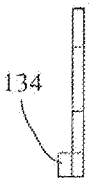
FIG. 10C is an end view of the second arm of the catch assembly of FIG. 10.

The second arm 130 is seen in detail within FIGS. 10-10C, and may, in general, be constructed similar to first arm 120. Second arm 130 may be an elongated thin flat plate member, with a hole 133 proximate to its first end 131, to be usable for pivotal mounting of the second arm to hole 124 of the first arm 120. At the first end 131 of the second arm 130, a small protrusion 134 may protrude orthogonally from the side of the arm, and may be formed by any of the means cited above for producing stop 125. The protrusion 134 shown within FIG. 10 is shown as a small tab at the first end 131 that is bent at roughly a 90 degree angle. The protrusion 134 works as a stop to limit the over rotation of the second arm 130 with respect to the first arm 120, and is received in the recess 126 of the first arm 120 when the sash is to maximum limit opening position, which his discussed further hereinafter. The second end 132 of the second arm 130 may have a shaped opening 135 therein, which may be generally rectangular, and which may further have a notch 135N therein, both of which are discussed later as to the operation of the opening control device.

The pivotal mounting of the second arm 130 to the first arm 120 may utilize a simple rivet or other mechanical fastener, and one of many different varieties of springs, which may be a tension spring or a torsion spring. Merely to be exemplary, use of torsion spring 140 and rivet 150 is utilized herein. An exemplary torsion spring 140 is illustrated within FIGS. 11-11C, and may include a small number of helical windings 140W or even just a portion of one winding that may terminate in a first end 141 via a radial portion 141R, and in a second end 142. The first and second ends 141 and 142 may be used to bias the second arm 130 with respect to the first arm 120. (An alternative V-shaped torsion spring 340 is disclosed hereinafter discussed alternate embodiment).

Figure 3:
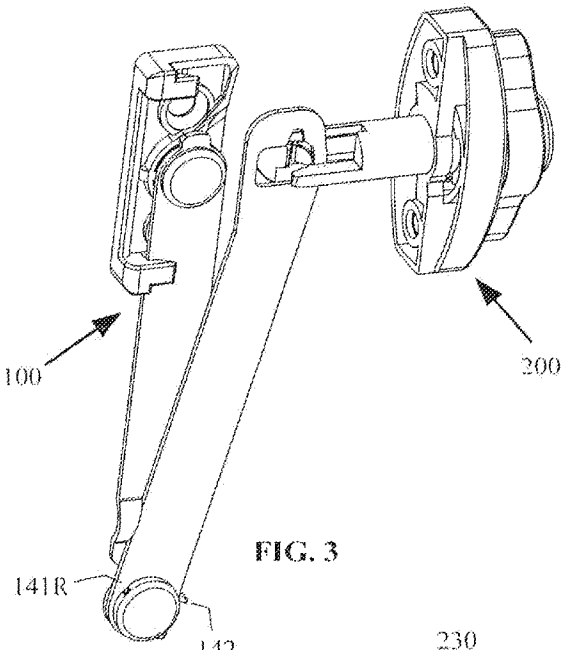
FIG. 3 illustrates the catch assembly and the release assembly of the window opening control device of FIG. 2, with the casement window omitted from the view, and with the catch assembly releasably secured to the release assembly, the arms of the catch assembly being in the retracted position, and with the sash having been closed with respect to the master frame.
Figure 12:
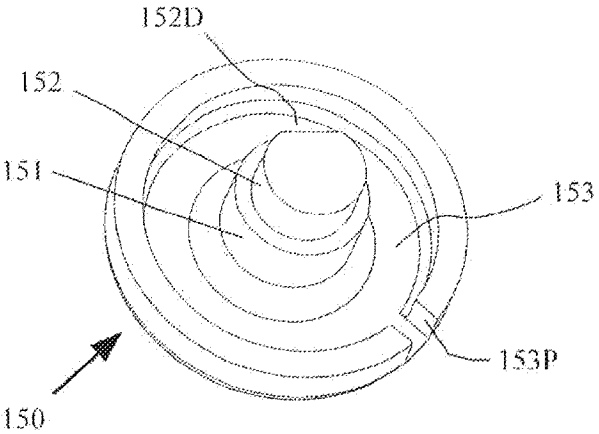
FIG. 12 is a perspective view of the rivet of the catch assembly of the opening control device of the present invention.
Figure 12C:
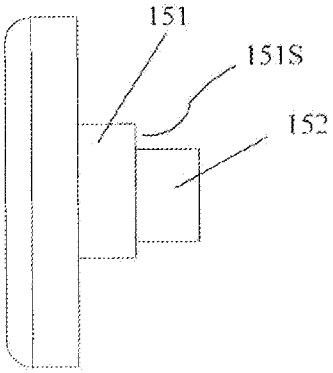
FIG. 12C is an end view of the rivet of the catch assembly of FIG. 12.
Figure 12B:
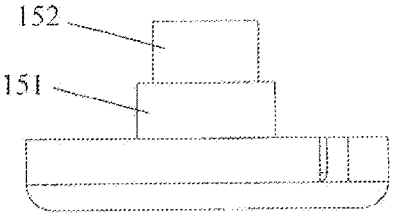
FIG. 12B is a side view of the rivet of the catch assembly of FIG. 12.
Figure 12A:
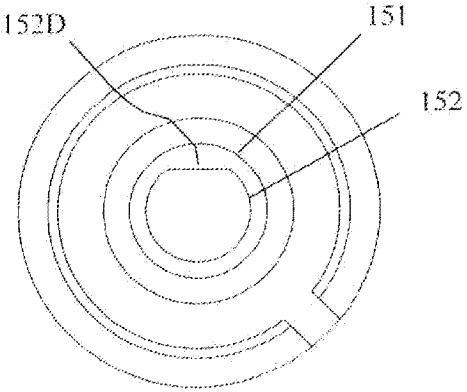
FIG. 12A is a front view of the rivet of the catch assembly of FIG. 12.

In this exemplary arrangement, a rivet 150, which is shown in detail within FIGS. 12-12C, may have a first post 151 extending from the head 153, and a second post 152 telescoping therefrom. Pivotal mounting of the first and second arms 120 and 130 may be achieved by first receiving the helical windings 140W of the torsion spring 140 upon the first post 151 of rivet 150, such that its radial portion 141R of the first end 141 is received through opening 153P in the head 153 of the rivet 150 (see FIG. 7 and FIG. 3). Next, the second arm 130 may be mounted upon the rivet 150 such that hole 133 of the second arm is received upon, and sized to be pivotal with respect to, the first post 151 of the rivet. The first arm 120 may then be mounted upon the rivet 150 such that hole 124 of the arm is received upon its second post 152. The side of the arm may abut the shoulder ISIS formed by the side of the post 151 and the post 152. The second end 142 of torsion spring 140 may loop about the side of the elongated flat plate of the first arm, as seen for example in FIG. 4. The post 152 may then be bucked to fixedly secure the first arm 120 to the shoulder 151S, so that there will be no relative motion therebetween. Instead of relying upon the bucked post 152 to fixedly secure the first arm 120 to the rivet 150, the post 152 may have a flat side 152D, as seen in FIG. 12A, to form a D-shaped profile, which may be mated to a correspondingly keyed opening 124D (FIG. 9A) that may be used instead of the plain round hole.

Figure 2B:
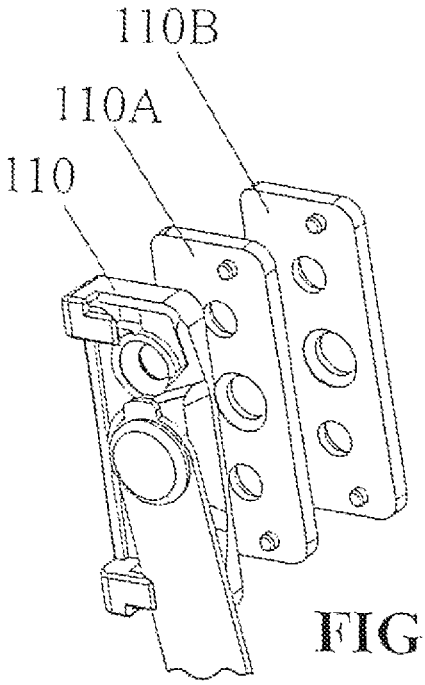
FIG. 2B is an enlarged detail view of the bracket of the catch assembly of FIG. 1, showing the possible use of backing plates to accommodate installation on a sash with a different profile.

Therefore, as seen in FIG. 2A, when the bracket 110 of catch assembly 100 is properly mounted to the sash (i.e., with the bracket generally oriented in the vertical direction and using backing plate(s) 110A/110B that are shown in FIG. 2B to accommodate different sash/frame profiles), the first arm 120 may normally pivot downwardly (clockwise in the view) about the bracket due to gravity, until reaching the stop 113A of the bracket. At the same time, torsional biasing provided by torsion spring 140 may cause the second arm 130 to pivot upwardly (counterclockwise in the view), in opposition of the force of gravity, until the side of the second arm contacts the stop 125 on the first arm 120. Without any forces acting upon the catch assembly 100, it may normally occupy this retracted position that is illustrated within FIG. 2A.

Figure 4:
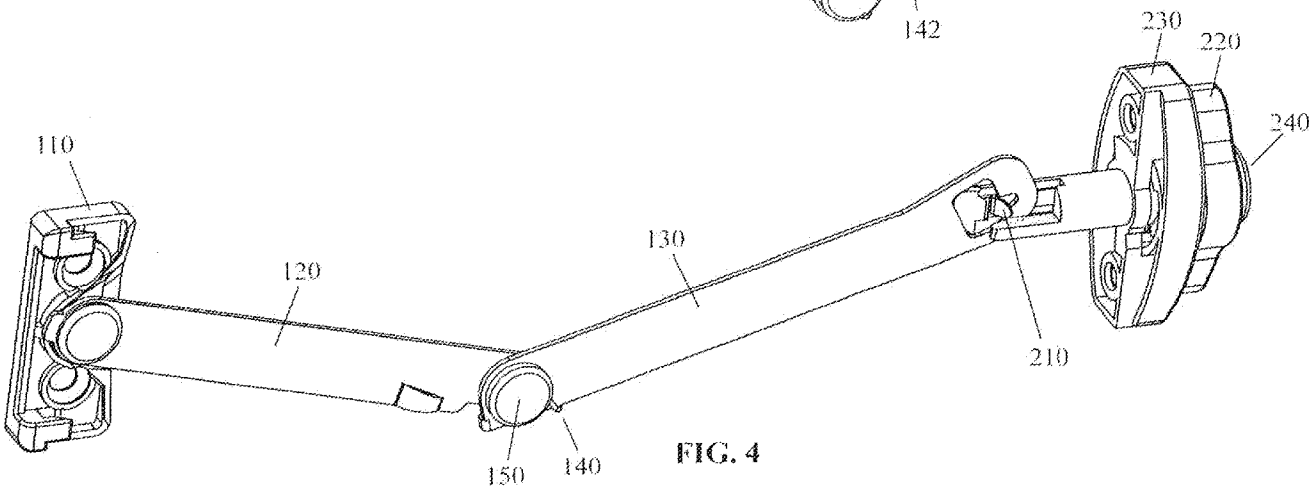
FIG. 4 illustrates the catch assembly and the release assembly of the window opening control device of FIG. 3, but with the arms of the catch assembly shown extended, for when the sash is opened with respect to the master frame, and thereby travel limited.
Figure 4A:
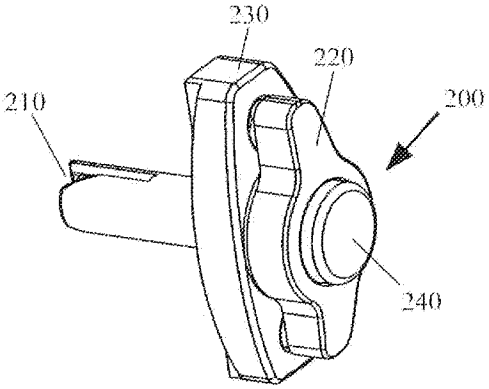
FIG. 4A illustrates a reverse perspective view of the release assembly of FIG. 4, where the safety button has not been depressed.

An exemplary release assembly 200 is shown separately in FIG. 4A, but in its simplest form it may instead consist of a hook element configured to be pivotally received in the master window frame, where a hook portion of the element may be configured to engage the shaped opening 135 in the second end of the second arm 130, and be disengaged therefrom through its pivotal motion within the master window frame. This pivotal movement of this hook element that enables engagement within the opening and disengagement therefrom of its hook portion, especially using the notch 135N in the second arm 130, may be seen in viewing FIGS. 4B and 5B. This simple version of the hook element may be a slightly modified version of the combination of the hook member 210 and base member 230 that are discussed hereinafter.

Figure 14:
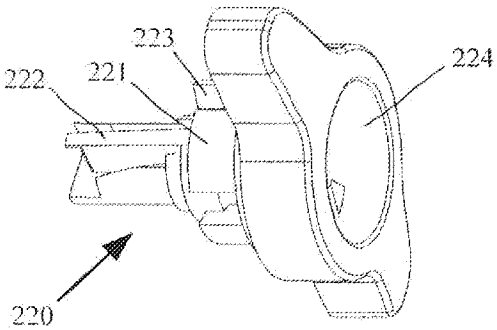
FIG. 14 is a perspective view of the switch member of the release assembly of the opening control device of the present invention.
Figure 14C:
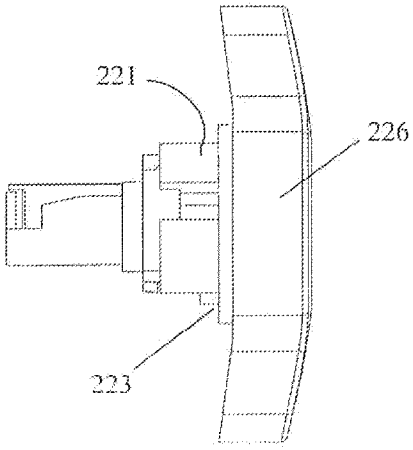
FIG. 14C is an end view of the switch member of the release assembly of FIG. 14.
Figure 14B:
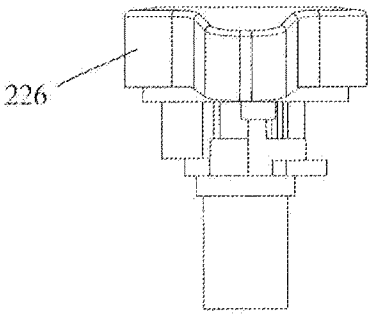
FIG. 14B is a side view of the switch member of the release assembly of FIG. 14.
Figure 15:
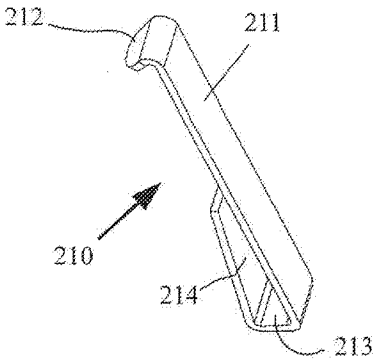
FIG. 15 is a perspective view of the hook member of the release assembly of the opening control device of the present invention.
Figure 15B:
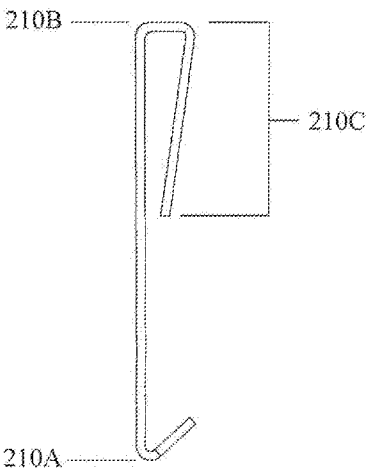
FIG. 15B is a side view of the hook member of the release assembly of FIG. 15.
Figure 15C:
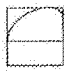
FIG. 15C is an end view of the hook member of the release assembly of FIG. 15.
Figure 15A:
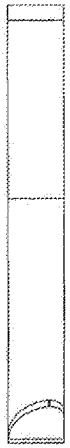
FIG. 15A is a front view of the hook member of the release assembly of FIG. 15.

For ease of manufacturing and/or other reasons, this simplified hook element may be replaced by the combination of the separate hook member 210 that is shown within FIGS. 15-15C and the separate graspable switch member 220 that is shown within FIGS. 14-14C.

The hook member may take many different shapes, however, the exemplary hook member 210 shown in FIG. 15 may be a narrow, thin-shaped material that is formed to have a hook portion 212 extending from a first, end 210A of its shank 211. The second end 210B of the shank 211 may have an eye formed thereat, or it may instead be formed with a return flange 214 that extends from a cross-member 213 to create a clasp portion 210C. The clasp portion 210C may be fixedly secured to a corresponding retaining member 222 formed within a recess 220R of the switch member 220, so that the angled hook portion 210C of hook 210 protrudes outwardly therefrom (see FIG. 2H). The length of the shank 211 and its shape may be particularly formed so as to permit the hook portion 212 to be somewhat flexible with respect to the clasp portion 210C, after it has been secured to the retaining member 222 of the switch member 220. The clasp portion 210C of hook member 210 may be fixedly secured within the corresponding recess 220R of the switch member 220 using a friction fit, or using adhesive, or mechanical fasteners, or any suitable fastening means or combination thereof.

Figure 13:
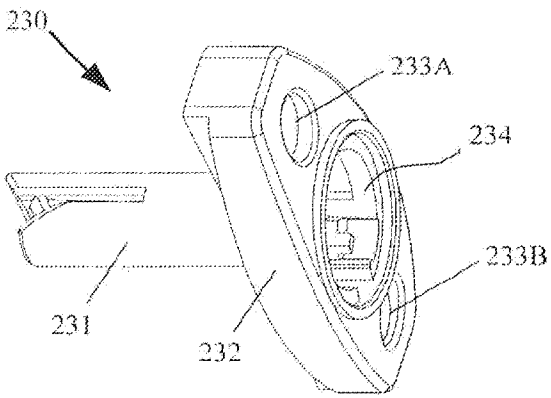
FIG. 13 is a perspective view of the base member of the release assembly of the opening control device of the present invention.
Figure 13C:
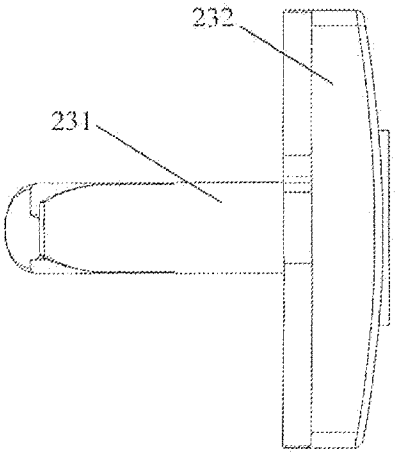
FIG. 13C is an end view of the base member of the release assembly of FIG. 13.
Figure 13B:
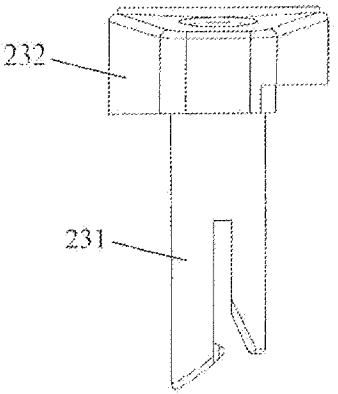
FIG. 13B is a side view of the base member of the release assembly of FIG. 13.

The shaft 221 of the switch member 220 may be formed to be pivotally received within a corresponding opening in the window master frame, and such an opening may be added to a window that is already installed and in service in a dwelling. However, to more easily accommodate installation of the release assembly 200 within the master frame of a newly manufactured window, and to further accommodate additional features of the opening control device of the present invention, the switch member 220 may instead be formed to be pivotally received within a base member 230, which is illustrated within FIGS. 13-13C.

Figure 2C:
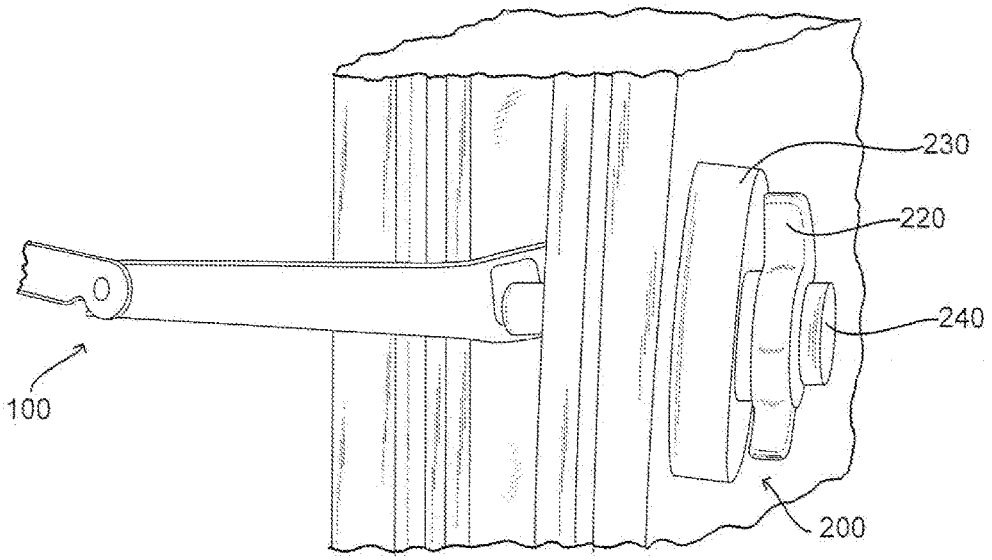
FIG. 2C is a side view of the release assembly and a portion of the catch assembly, as installed on the casement window of FIG. 1.
Figure 2D:
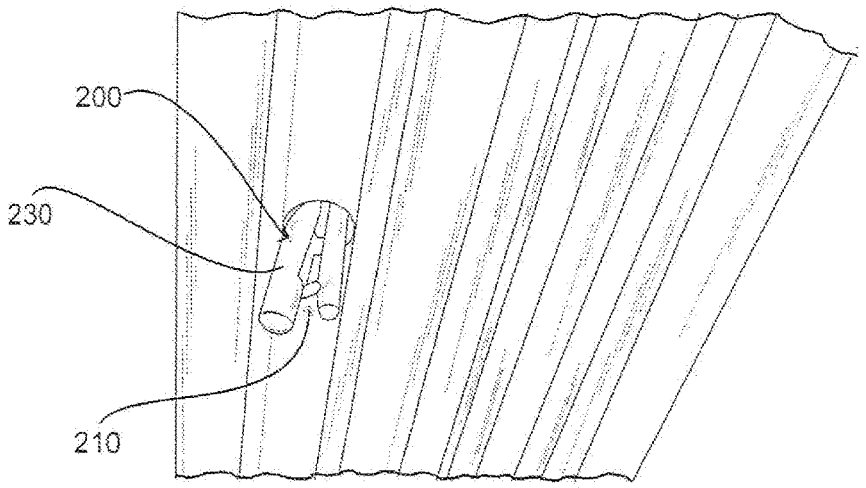
FIG. 2D is a front view of the release assembly protruding through the master frame of the casement window of FIG. 2C.
Figure 2E:
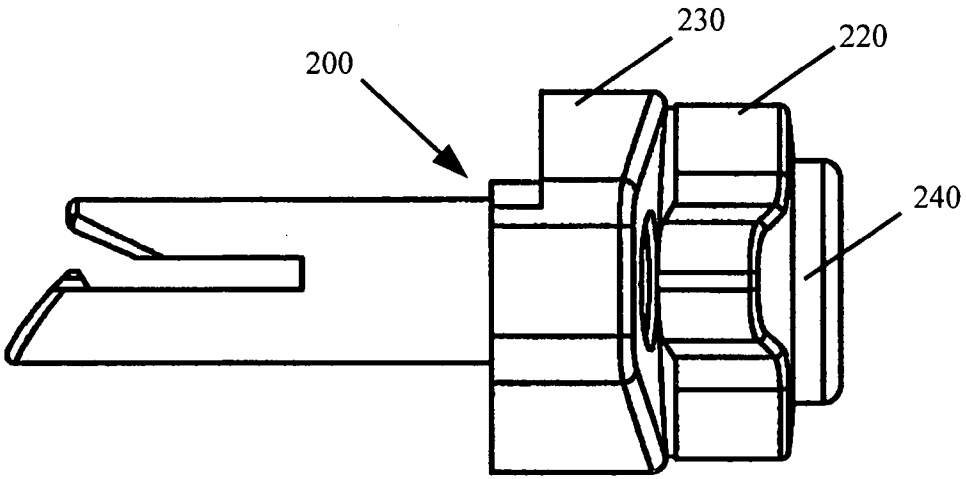
FIG. 2E is a top view of the release assembly of FIG. 2D, shown by itself.

The base member 230 may have a correspondingly shaped shaft 231 that extends from a flange 232. The flange 232 may have a pair of holes 233A and 233B formed therein to receive fasteners for mounting of the base member to the master window frame 21, as seen in FIG. 2C. FIG. 2D shows the shaft 231 of the base member 230 installed within, and protruding from, the opening in the master window frame.

Figure 5:
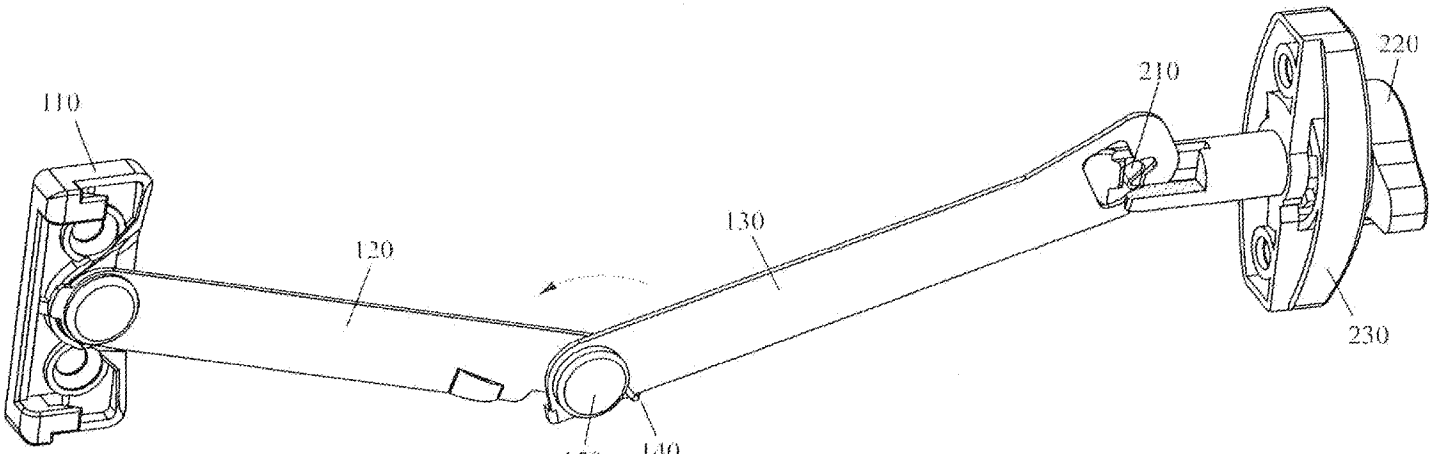
FIG. 5 illustrates the catch assembly and the release assembly of the window opening control device of FIG. 4, but with the safety button having been depressed, and the switch member pivoted to release the hook of the release assembly from the opening of the second arm of the catch assembly.
Figure 5A:
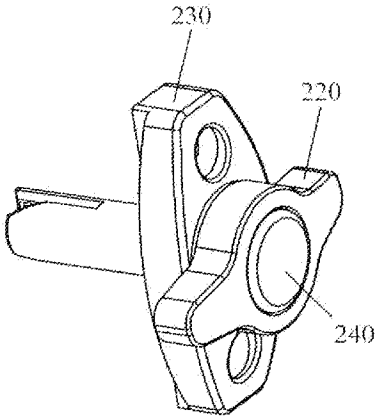
FIG. 5A illustrates a reverse perspective view of the release assembly of FIG. 5, where the safety button has been depressed, and the switch member pivoted.

The shaft 221 of the switch member 220 may have a stop 223 protruding therefrom (FIG. 14), which may serve to limit pivotal travel of the switch member to 90 degrees of travel within the shaft 231 of the base member 230 (FIGS. 4A and 5A). The travel of the switch member 220 may be so limited by a pair of corresponding stops formed within the hollow of the shaft 231 of the base member 230.

Figure 16:
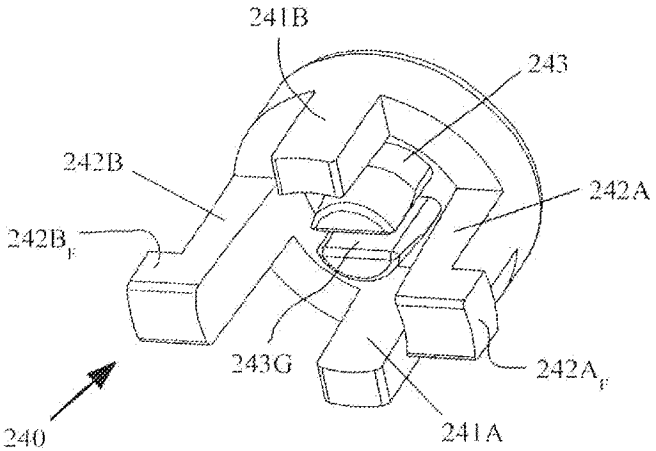
FIG. 16 is a perspective view of the safety button of the release assembly of the opening control device of the present invention.
Figure 16C:
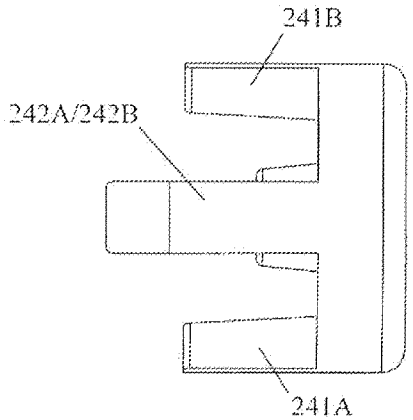
FIG. 16C is an end view of the safety button of the release assembly of FIG. 16.
Figure 17:
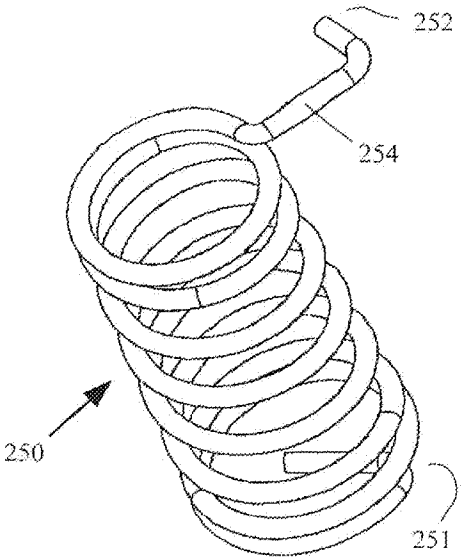
FIG. 17 is a perspective view of the spring of the release assembly of the opening control device of the present invention.
Figure 17B:
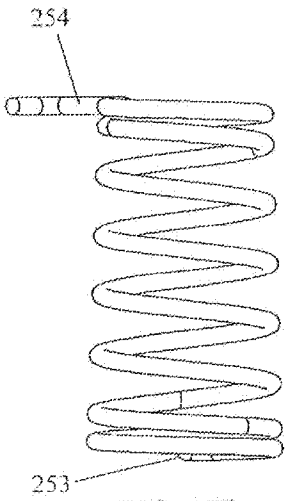
FIG. 17B is a side view of the spring of the release assembly of FIG. 17.
Figure 17C:
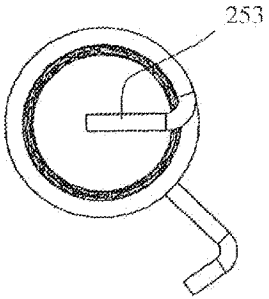
FIG. 17C is an end view of the spring of the release assembly of FIG. 17.
Figure 17A:
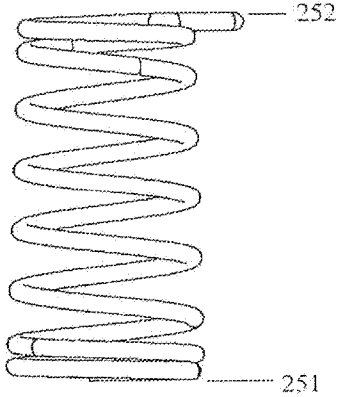
FIG. 17A is a front view of the spring of the release assembly of FIG. 17.
Figure 18B:
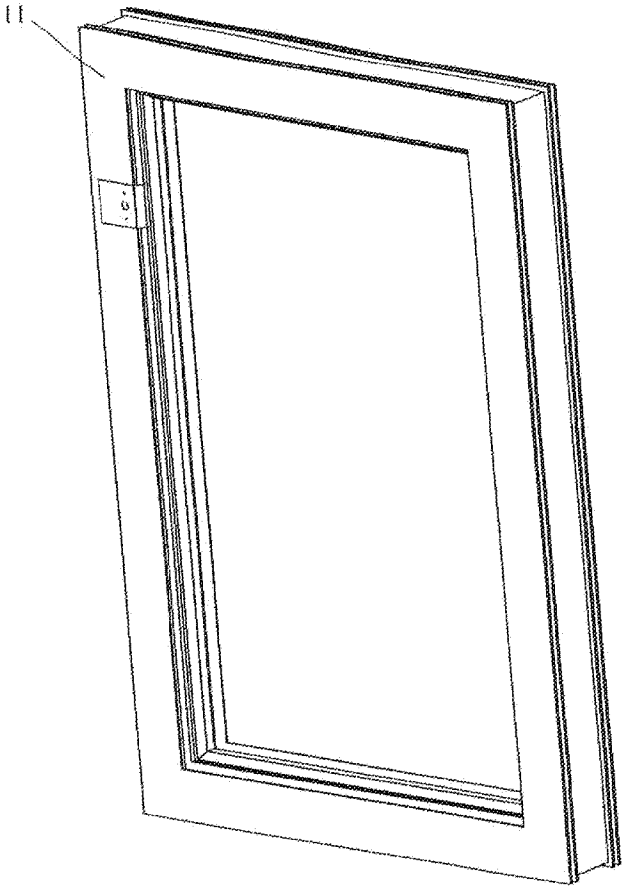
FIG. 18B shows the decal of FIG. 18B being further used to coordinate the hole positions on the sash with proper positioning of the holes on the master window frame, for proper mounting thereon of the release assembly.
Figure 18A:
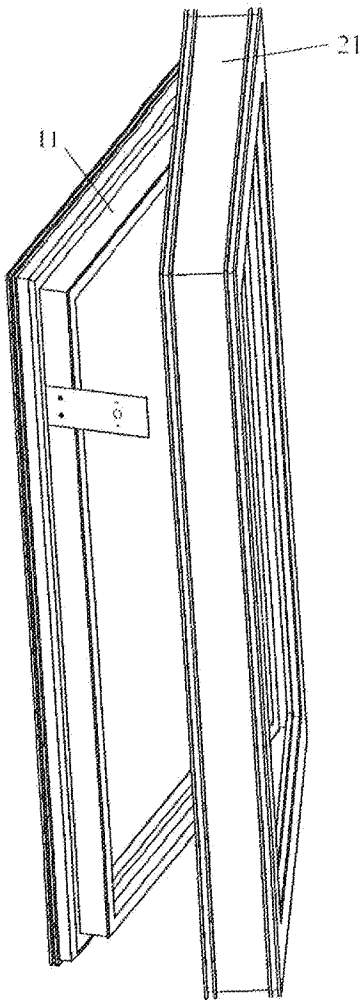
FIG. 18A shows the decal of the exploded view of FIG. 7 that may be used to position holes on the sash for proper positioning thereon of the catch assembly of the opening control device of the present invention.

As an additional safety precaution, to better prevent a mischievous child from rotating the switch member 220 to disengage the opening control device to open the window fully, the device of the current invention may furthermore include a safety button 240, which is illustrated within FIG. 16-16C, and which may be biased by the helical spring 250 that is shown within FIGS. 17-17C. The safety button 240 may have a cylindrical head portion 240H, from which may extend two pairs of legs—a first pair of legs, 241A and 241B, and a second pair of legs, 242A and 242B. The safety button 240 may also have a post 243 protruding away from the bottom of the head portion 240H, upon which may be received the first end 251 of the helical spring 250.

This combination of helical spring 250 and safety button 240 may be received within the opening 224 in the shaft of the switch member 220, such that the pairs of legs are slidably received within corresponding elongated recesses therein, which may serve to prevent rotation of the safety button with respect to the switch member. The second pairs of legs, 242A and 242B, as seen in FIG. 16, which may be longer than the first pair of legs, may have respective outwardly extending flanges 242$A_F$ and 242$B_F$.

Figure 14A:
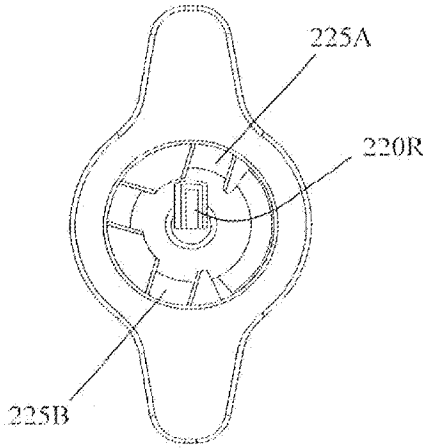
FIG. 14A is a front view of the switch member of the release assembly of FIG. 14.
Figure 16A:
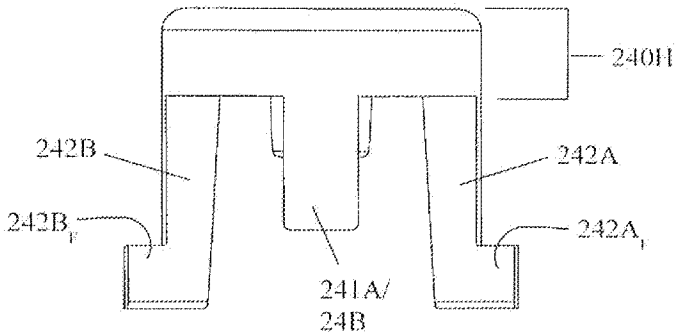
FIG. 16A is a front view of the safety button of the release assembly of FIG. 16.
Figure 16B:
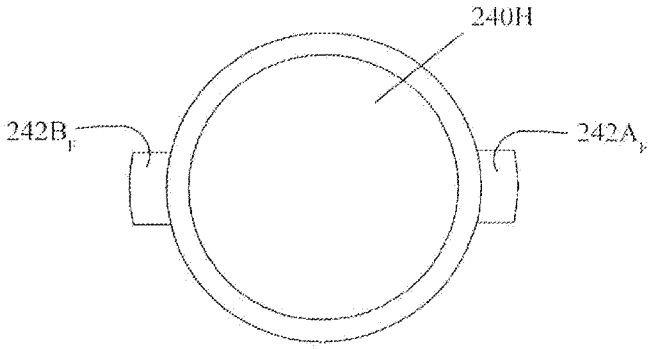
FIG. 16B is a side view of the safety button of the release assembly of FIG. 16.

Although it may be understood by one skilled in the art that other features may be used to similarly accomplish functional mating of the safety button 240, the switch member 220, and the base member 230, the second pair of legs 242A and 242B of the safety button may herein be received through correspondingly shaped openings 225A and 225B in the switch member (FIGS. 7 and 14A), to secure the safety button to the switch member. The second pair of legs will need to be elastically deflected inwardly in order for the outwardly extending flanges 242$A_F$ and 242$B_F$ of the legs to be received through the opening 224 in the shaft 221 of the switch member 220. Once having passed therethrough, the legs would naturally deflect back to their undeformed position, as seen in FIG. 16A, and may thereby secure the safety button 240 with respect to the switch member 220, as a portion of the outwardly extending flanges 242$A_F$ and 242$B_F$ of the legs would now overhang beyond the diametrical periphery of the shaft 221 (see FIGS. 14C and 16B). The helical spring 250 retained between the safety button 240 and the base member 230 may serve to normally bias the button to have a portion protrude outwardly beyond the graspable handle portion 226 of the switch member 220 (FIG. 4A).

Figure 2F:
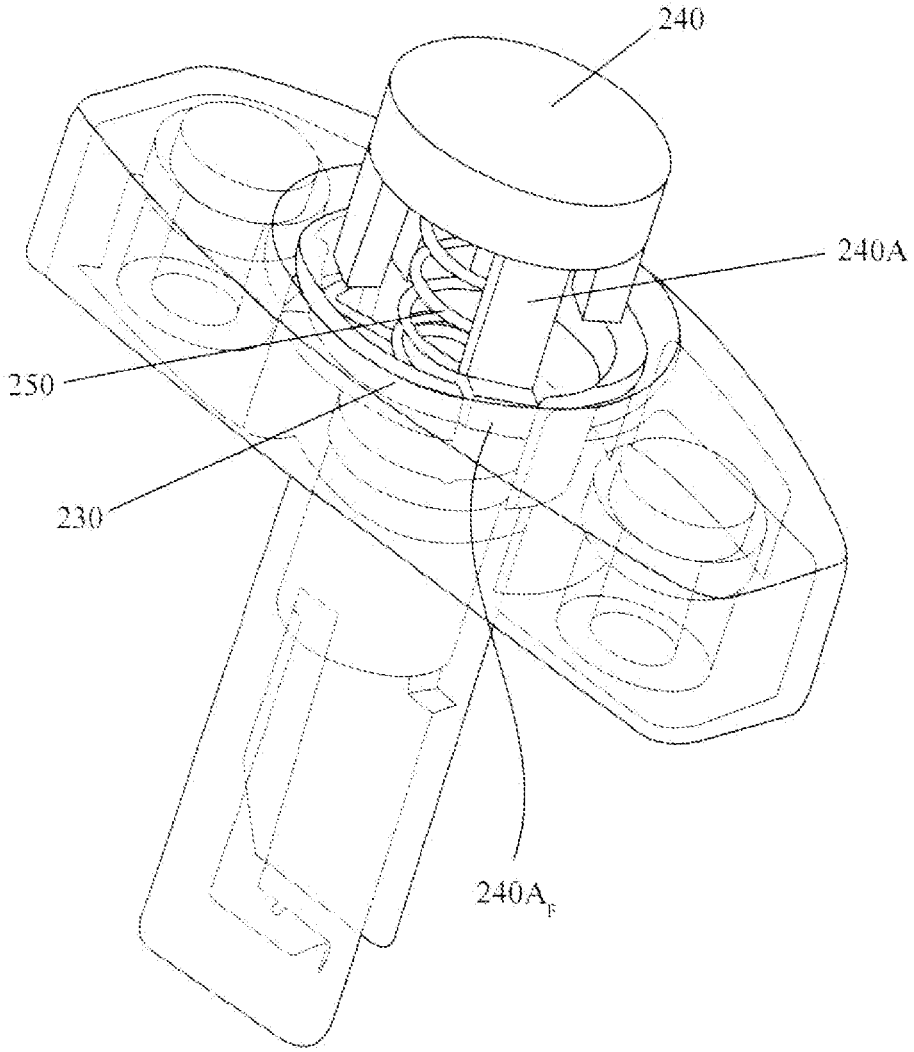
FIG. 2F is a perspective view of the release assembly of FIG. 2E, but shown with the switch member cut away.
Figure 2G:
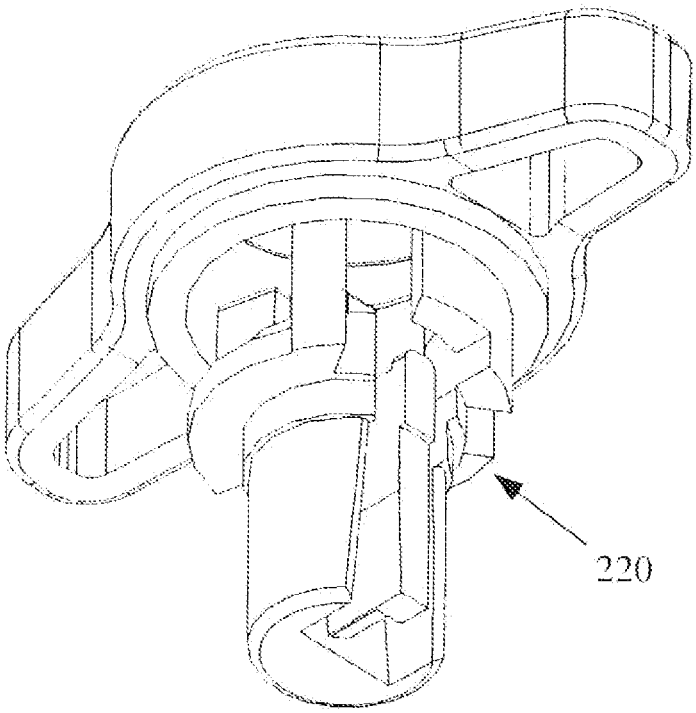
FIG. 2G is a bottom perspective view of the switch member.
Figure 2H:
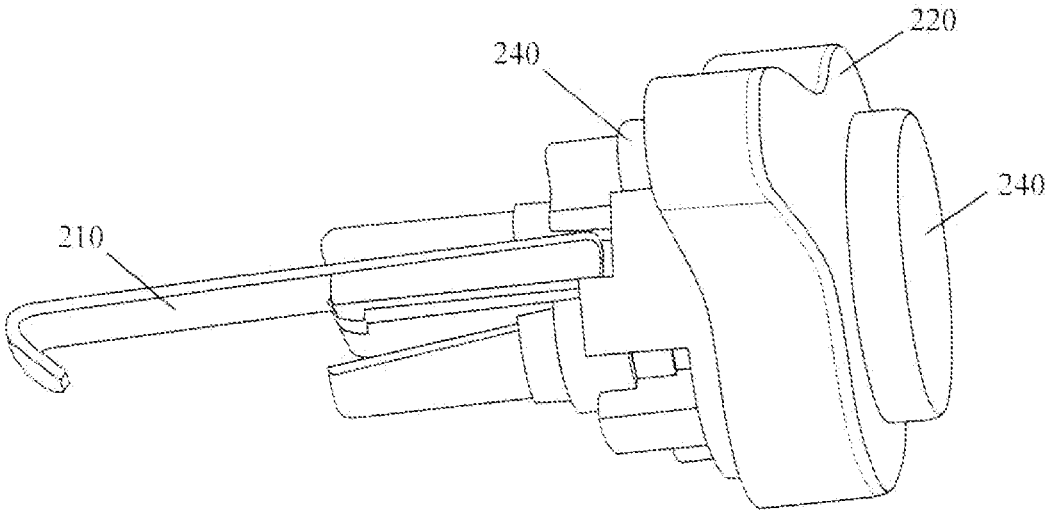
FIG. 2H is a perspective view of the assembled hook member, the turning switch, and the safety button of the present invention.
Figure 13A:
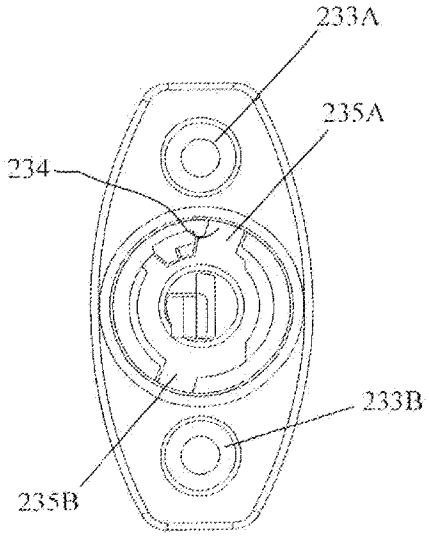
FIG. 13A is a front view of the base member of the release assembly of FIG. 13.

This subassembly—the switch member 220, the safety button 240, and the spring 250—may be coupled with the base member 230, with the shaft 221 of the switch member being received within the opening 234 of the shaft 231 of the base member 230. The second pair of legs 242A and 242B may again need to be elastically deflected inwardly in order for the outwardly extending flanges 242$A_F$ and 242$B_F$ thereon that protrude beyond the diametrical periphery of the shaft 221, to be received through the opening 234 in the shaft 231 of the base member 230. The outwardly extending flanges 242$A_F$ and 242$B_F$ may also be aligned to be received through the correspondingly shaped openings 235A and 235B in the base member (see FIG. 7, and FIGS. 13A, 14A, and 16B). Once having passed therethrough, the second pair of legs would again naturally deflect outwardly back to their undeformed position and would extend slightly beyond the periphery of the opening 234 (FIG. 13A), to thereby secure the subassembly of the switch member 220, spring 250, and safety button 240 with respect to the base member 230. In addition, with the formation of the shaped openings 235A and 235B in the base member, the lateral extent of which may protrude in the axial direction to be slightly beyond the point where the outwardly extending flanges 242$A_F$ and 242$B_F$ overhang the periphery of the opening 234 of the shaft 231, pivoting of the switch member relative to the base member may thereby be inhibited. This functions as a safety—a means of preventing inadvertent actuation of the release member of opening control device, by some person not familiar with the device (i.e., a child-proof safety). However, by depressing the safety button 240 to overcome the biasing by spring 250, the portion of the outwardly extending flanges 242$A_F$ and 242$B_F$ of the second pair of legs that were still nested within the lateral extent of the openings 235A and 235B in the base member, may now protrude beyond its extent, and thus the switch member is then free to pivot until such pivoting is limited by the aforementioned stops, being after roughly 90 degrees of rotation (see FIGS. 2F, 2G, and 2H).

Another additional feature that may be incorporated into release assembly 200 may be the further provision that the helical compression spring 250 that is used to normally bias the safety button 240 outwardly from the opening 224 in the switch member 220, may also be formed to have its first and second ends 251 and 252 be usable for providing torsional biasing of the switch member 220 relative to the base member 230. The radial over-center portion 253 of spring 250 at its first end 251 (FIG. 17C) may be received in the groove 243G in the post 243 of the head 240H of the safety button 240 (FIG. 16). Also, the outwardly extending hook portion 254 at the second end 252 of the spring 250 may similarly be restrained within a portion of the base member 230. Therefore, when the safety button 240 of the release assembly 200 is depressed and the switch member 220 is manually pivoted 90 degrees to thereby also pivot hook portion 212 (FIG. 5A), after the user releases his/her grip from the switch member, the dual-biasing spring 250 may then serve to bias the switch member to counter-rotate the 90 degrees, and as well as serve to bias the safety button to translate outwardly to once again be positioned as seen in FIG. 4A.

Operation of the opening control device of the present invention may thus be understood by initially viewing FIG. 2. With the catch assembly 100 shown in its normally retracted position on window sash 11, as described hereinabove, the opened window sash may then be closed, which may serve to bring the catch assembly on the sash into proximity with the release assembly 200 on the master window frame, and cause engagement between the hook portion 212 of the hook member 210 and the shaped opening 135 of the second arm 130. This is illustrated within FIG. 3, in which the sash and the master window frame are not shown, to better illustrate the engagement therebetween, which occurs automatically through the mere closing of the window. The flexibility of the shank 211 of the hook 210 may serve to aid in the engagement therebetween, as the approaching side of the second arm 130 may cause the angled hook portion 212 to deflect out of its way, and then it may deflect back, as the opening 135 in the arm reaches the hook portion 212. The generally rectangular shape of the opening 135 in the second arm 130 may also serve to better accommodate capture of the hook portion 212 of the shank 211 of hook member 210, which will be protruding substantially orthogonally from the master window frame 21.

When the user opens the window, the bracket 110 on the sash moves away from the release assembly 200 on the master window frame. The engagement between the hook portion 212 of the hook member 210 and the shaped opening 135 of the second arm 130 serves to overcome the torsional biasing of the spring 140, so that increasing distance between the sash 11 and master frame 21 (FIG. 1) results in the extension of the first and second arms 120 and 130, as seen in FIG. 4. (Note, recess 126 on first arm 120 and small tab 134 on second arm 130 may prevent over-travel therebetween). The length of the first and second arms 120 and 130 may be sized so that this limited travel of the sash 11 is small enough to prevent a child from accidentally falling through the opening, and may be roughly four inches.

Figure 5B:
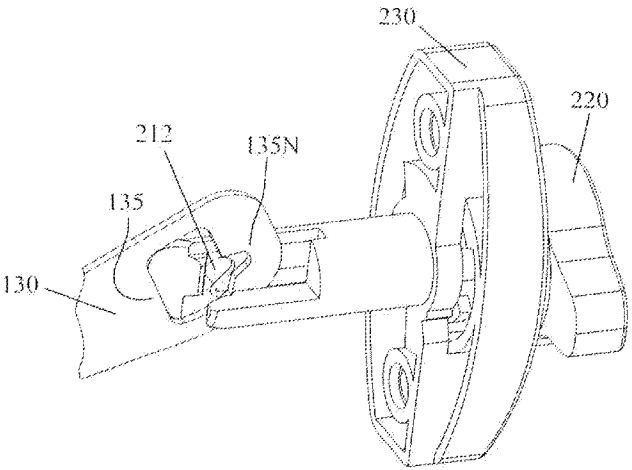
FIG. 5B is an enlarged detail view of the release assembly shown in FIG. 5.
Figure 4B:
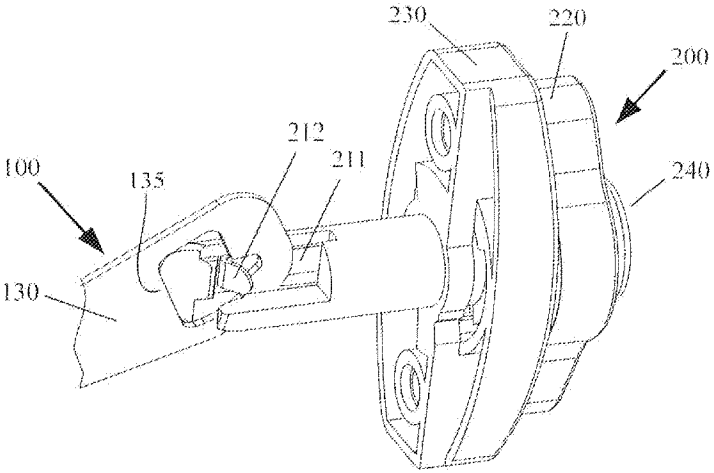
FIG. 4B is an enlarged detail view of the release assembly retaining the second arm of the catch assembly, as seen in FIG. 4.
Figure 6:
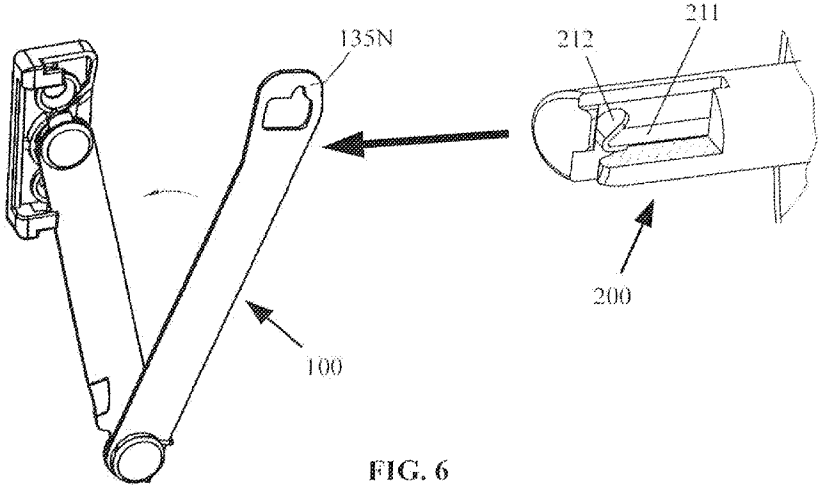
FIG. 6 illustrates the catch assembly and the release assembly of the window opening control device of FIG. 5, but with arms of the catch assembly moving into the retracted position as a result of spring biasing.

As seen in FIGS. 1 and 2, the opening control device may be positioned on an upper part of the sash and master window frame to make it more difficult for a small child to reach the release assembly. When an adult desires to open the window beyond the travel limited position of FIG. 1, the safety button 240 of the release assembly 200, as seen in FIG. 4A, may be depressed and the switch member 220 may be rotated, so that it appears as shown in FIG. 5A. This results in the hook portion 212 of hook member 210 moving from its initial engaged position, as seen in FIG. 4B, to the disengage position, as seen in FIG. 5B. Note that the notch 135N in the opening 135 of the second arm 130 may be shaped as shown in FIG. 10A, so that with the second arm extended as seen in FIG. 4, rotation of the hook member 210 would not tend to cause its hook portion 212 to jam against the side of second arm, and may freely exit from the opening 135 through the notch, as shown in FIG. 5B. The hook member may thus be freely rotated from its first hooked position, wherein the hook 212 of the release assembly is connected with the second arm of the catch assembly, to its second unhooked or position. Once the hook 210 is disengaged, retraction of the arms may occur, where the force of gravity may cause the first and second arms 120 and 130 to drop vertically, and the second arm may also pivot with respect to the first arm, due to biasing by spring 140, and both may move away from the release assembly 200, as seen in FIG. 6, until reaching the retracted position seen in FIG. 2. The sash may now be fully opened.

Figure 7:
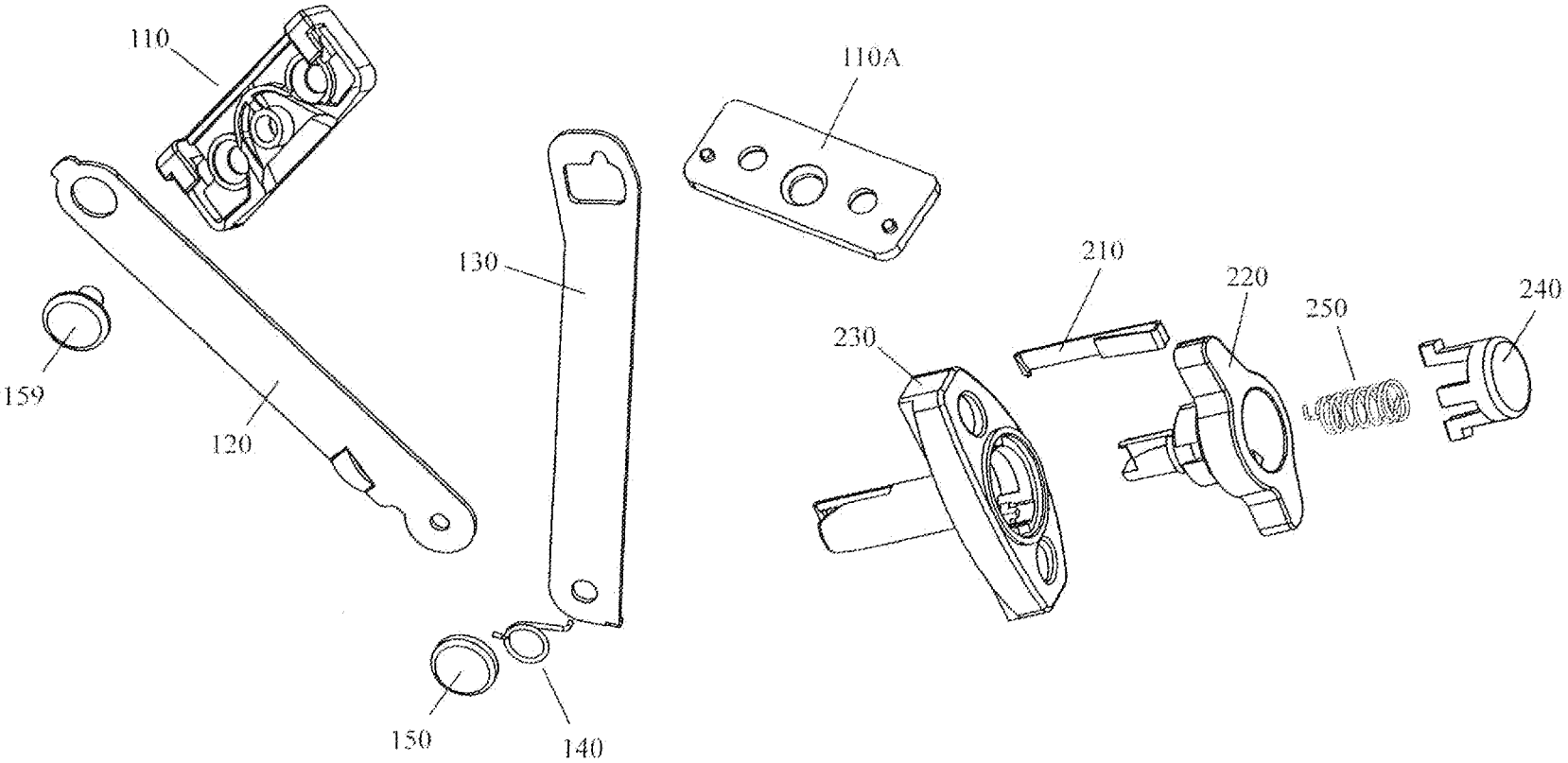
FIG. 7 is an exploded view of the parts used for assembly and installation of the opening control device of the present invention.
Figure 19:
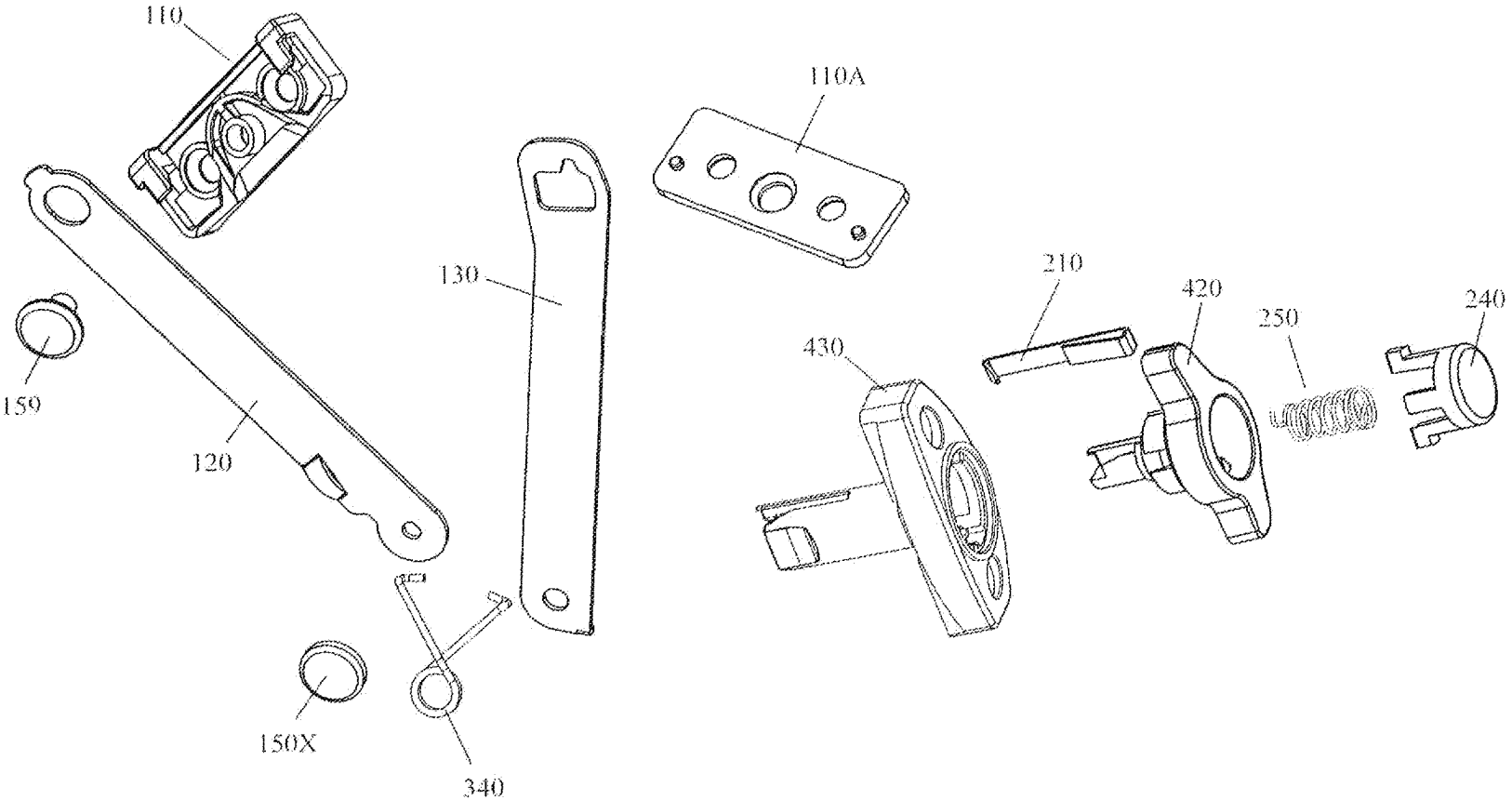
FIG. 19 is an exploded view of the parts forming a second embodiment of the opening control device of the present invention, including a V-shaped torsion spring.

An alternate embodiment of the catch assembly 100 and release assembly 200 may be catch assembly 101 and release assembly 201 that is formed using component parts being generally the same as those in FIG. 7, but with some minor adjustments have been made thereto, and with the modified parts being shown within the exploded view of FIG. 19.

Figure 11:
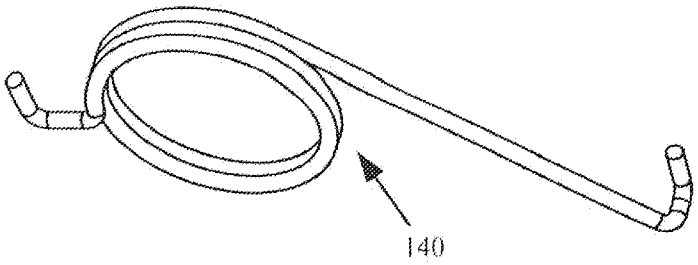
FIG. 11 is a perspective view of the torsion spring of the catch assembly of the opening control device of the present invention.
Figure 11C:
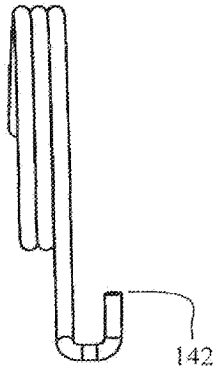
FIG. 11C is an end view of the torsion spring of the catch assembly of FIG. 11.
Figure 11B:
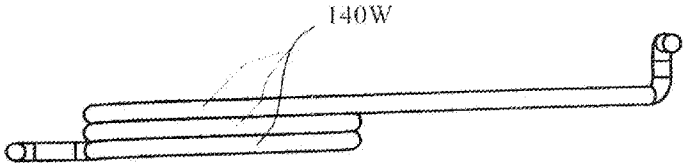
FIG. 11B is a side view of the torsion spring of the catch assembly of FIG. 11.
Figure 11A:
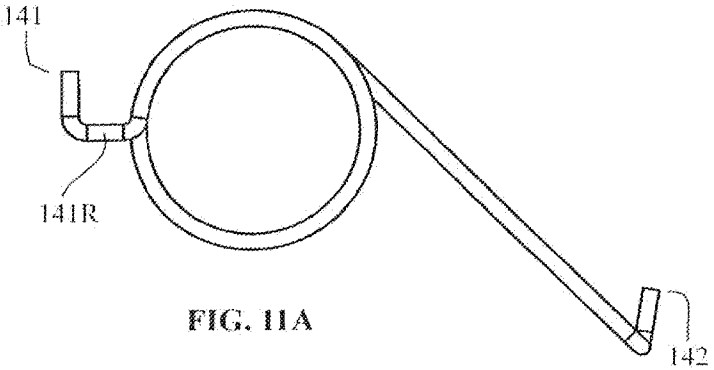
FIG. 11A is a front view of the torsion spring of the catch assembly of FIG. 11.
Figure 20:
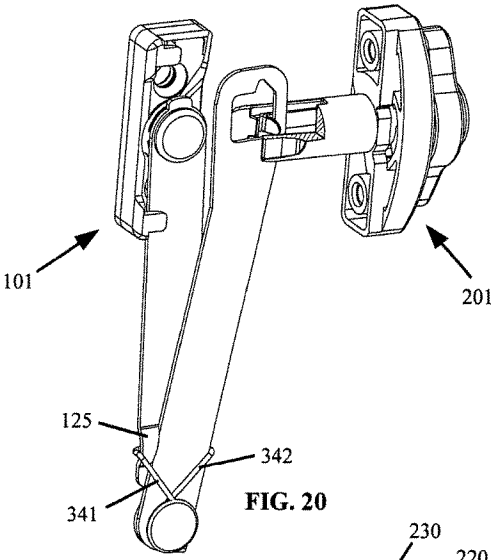
FIG. 20 illustrates the catch assembly and the release assembly of the second embodiment of the window opening control device of the present invention, with the casement window omitted from the view, and with the catch assembly releasably secured to the release assembly, the arms of the catch assembly being in the retracted position, and with the sash having been closed with respect to the master frame.
Figure 21:
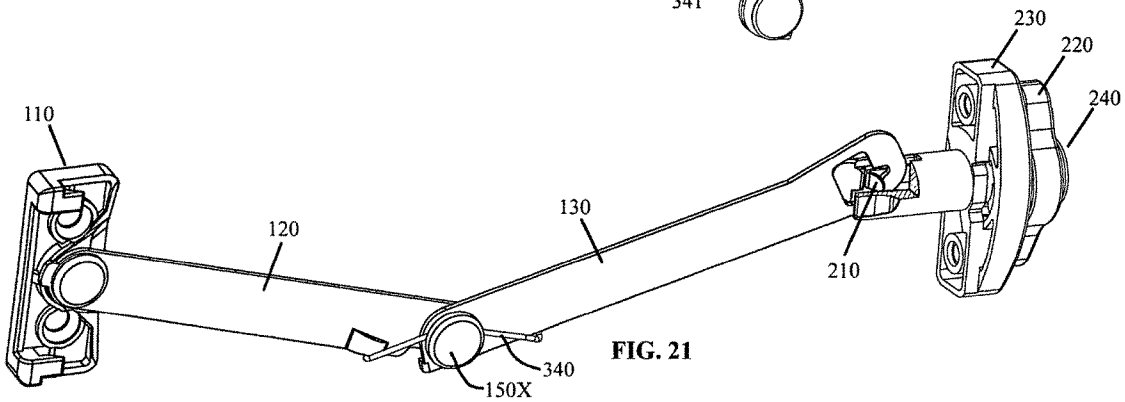
FIG. 21 illustrates the catch assembly and the release assembly of the window opening control device of FIG. 20, but with the arms of the catch assembly shown extended, for when the sash is opened with respect to the master frame, and thereby travel limited.
Figure 22A:
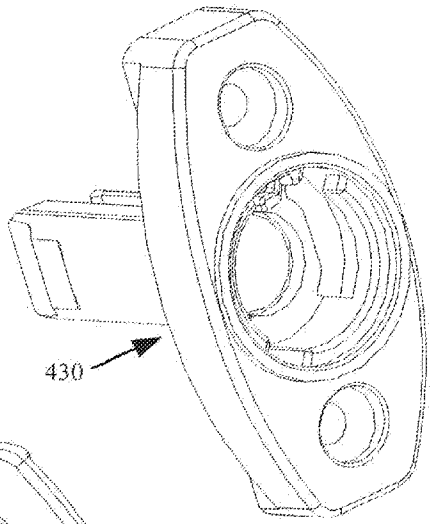
FIG. 22A is a second perspective view of the base member of FIG. 22.
Figure 22E:
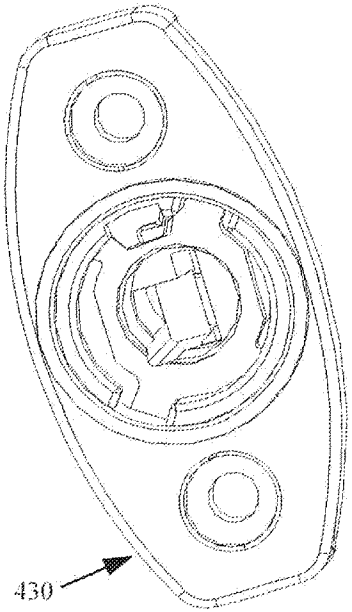
FIG. 22E is a sixth perspective view of the base member of FIG. 22.
Figure 22D:
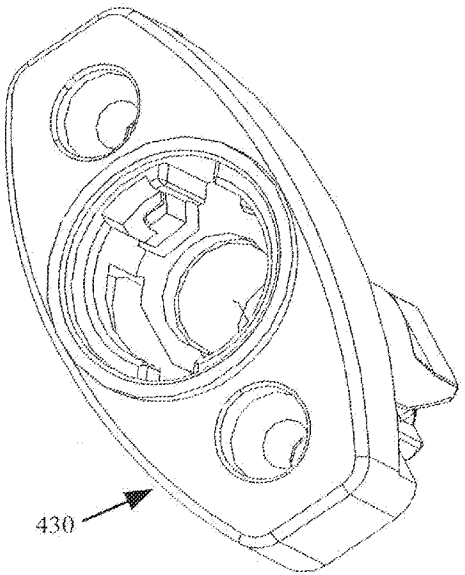
FIG. 22D is a fifth perspective view of the base member of FIG. 22.
Figure 22B:
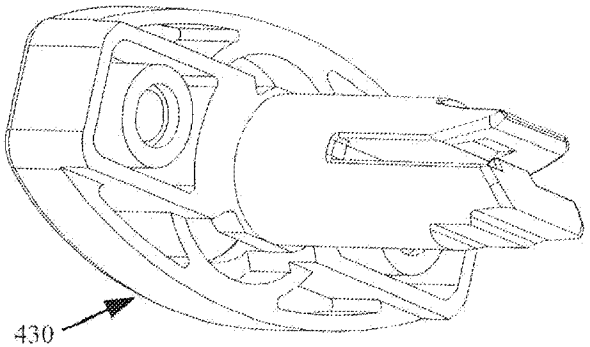
FIG. 22B is a third perspective view of the base member of FIG. 22.
Figure 22C:
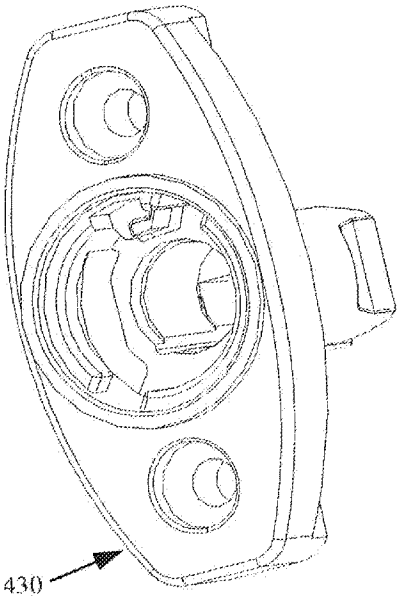
FIG. 22C is a fourth perspective view of the base member of FIG. 22.
Figure 22:
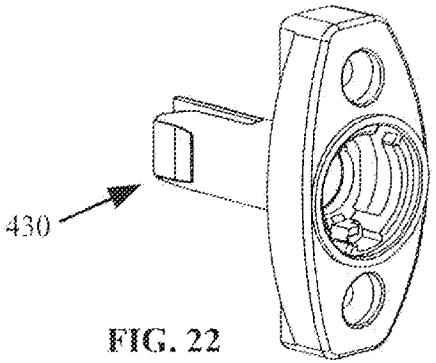
FIG. 22 is a first perspective view of the base member of the release assembly of the second embodiment of the opening control device of the present invention.
Figure 23A:
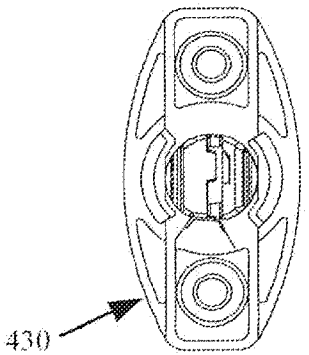
FIG. 23A is a rear view of the base member of FIG. 22.
Figure 24:
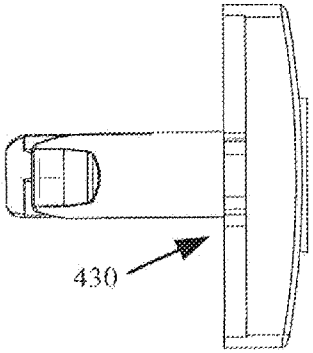
FIG. 24 is a first side view of the base member of FIG. 22.
Figure 25:
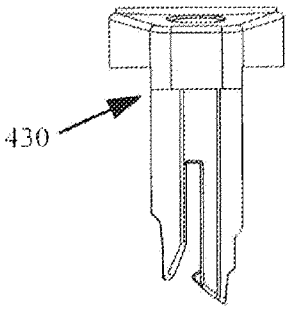
FIG. 25 is an end view of the base member of FIG. 22.
Figure 23:
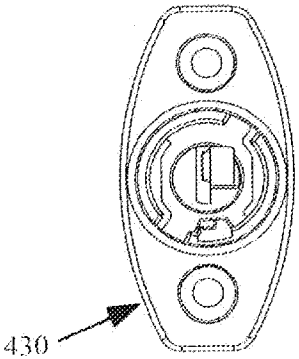
FIG. 23 is a front view of the base member of FIG. 22.
Figure 24A:
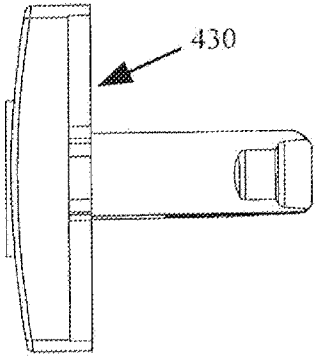
FIG. 24A is a second side view of the base member of FIG. 22.
Figure 26B:
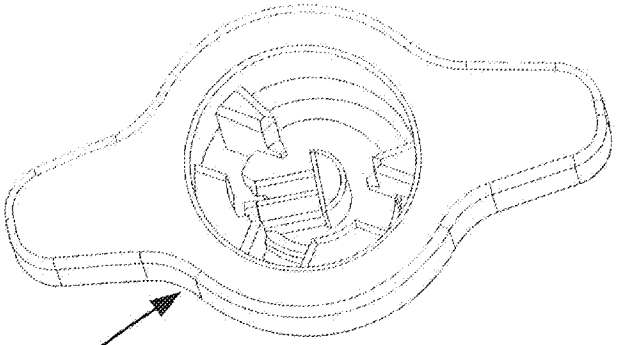
FIG. 26B is a third perspective view of the switch member of FIG. 26.
Figure 26E:
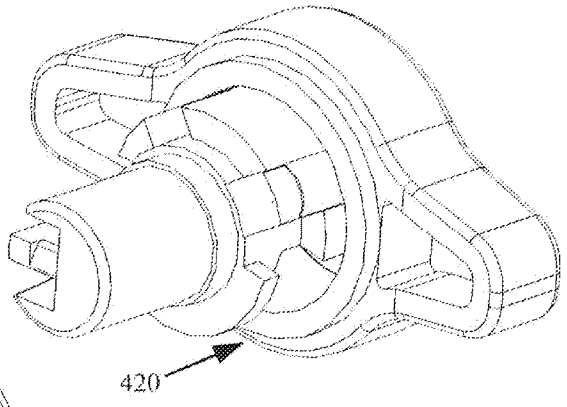
FIG. 26E is a sixth perspective view of the switch member of FIG. 26.
Figure 26D:
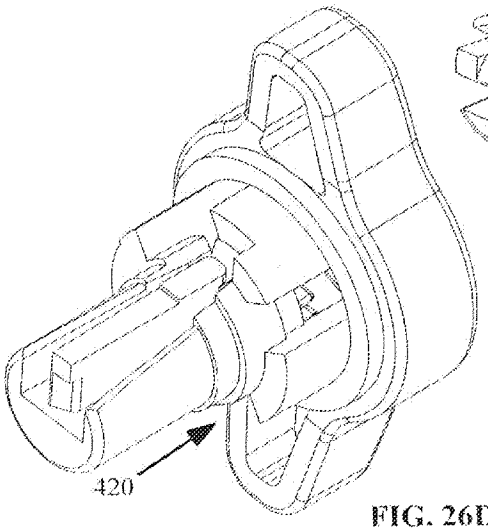
FIG. 26D is a fifth perspective view of the switch member of FIG. 26.
Figure 26A:
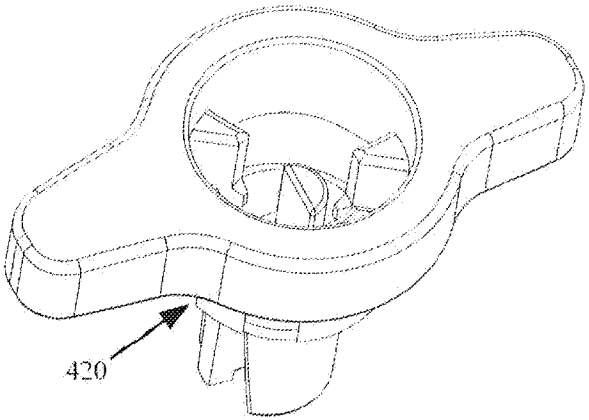
FIG. 26A is a second perspective view of the switch member of FIG. 26.
Figure 26C:
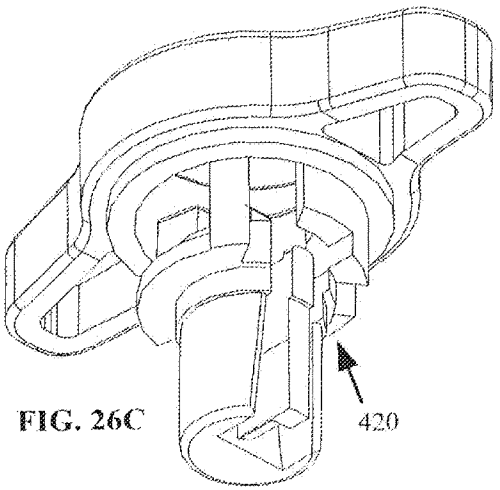
FIG. 26C is a fourth perspective view of the switch member of FIG. 26.
Figure 26:
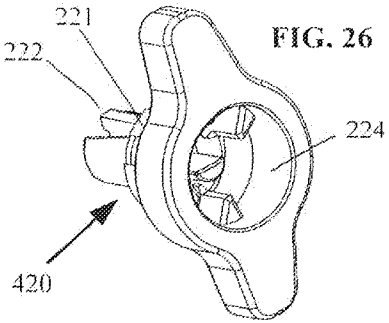
FIG. 26 is a first perspective view of the switch member of the release assembly of the second embodiment of the opening control device of the present invention.
Figure 27A:
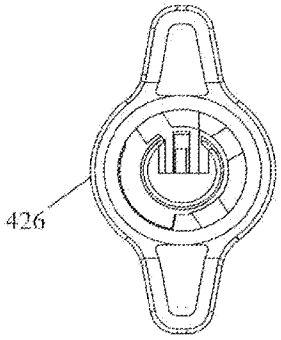
FIG. 27A is a rear view of the switch member of FIG. 26.
Figure 28:
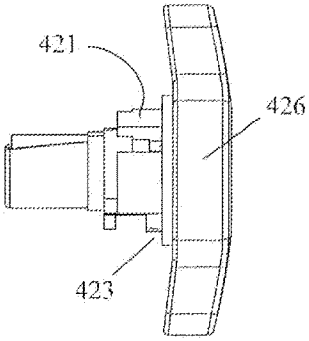
FIG. 28 is a first side view of the switch member of FIG. 26.
Figure 29:
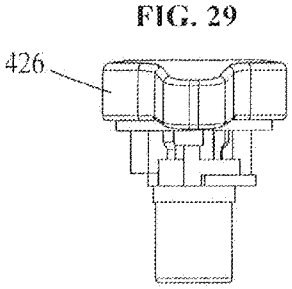
FIG. 29 is a first end view of the switch member of FIG. 26.
Figure 27:
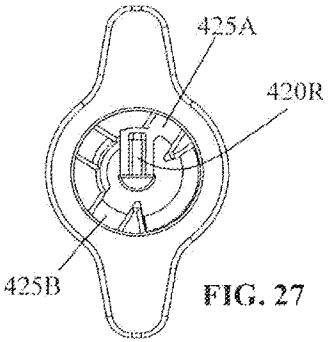
FIG. 27 is a front view of the switch member of FIG. 26.
Figure 29A:
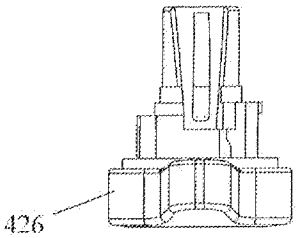
FIG. 29A is a second end view of the switch member of FIG. 26.
Figure 28A:
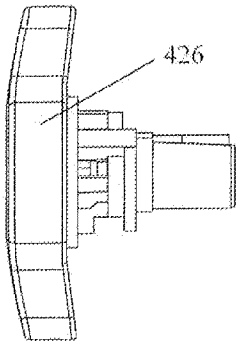
FIG. 28A is a second side view of the switch member of FIG. 26.
Figure 30:
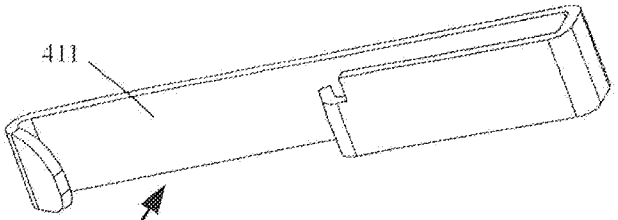
FIG. 30 is a perspective view of the hook member of the release assembly of the second embodiment of the opening control device of the present invention.
Figure 32:
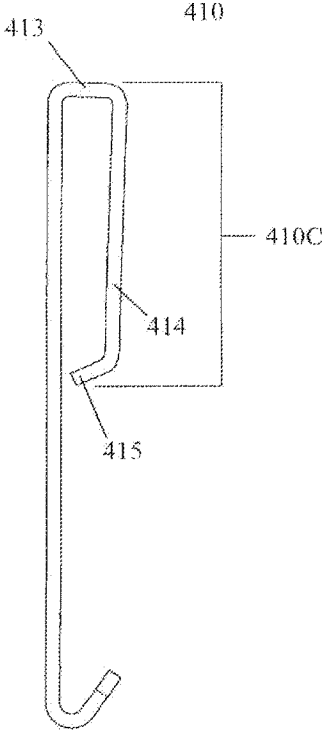
FIG. 32 is a side view of the hook member of FIG. 30.
Figure 33:
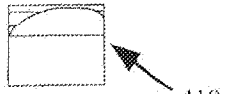
FIG. 33 is an end view of the hook member of FIG. 30.
Figure 31:
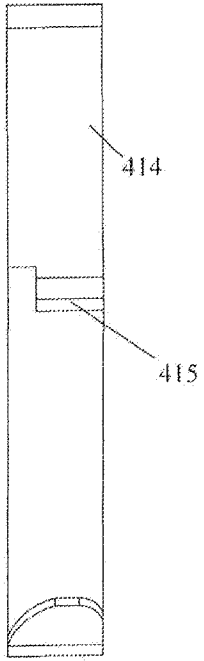
FIG. 31 is a front view of the hook member of FIG. 30.
Figure 34:
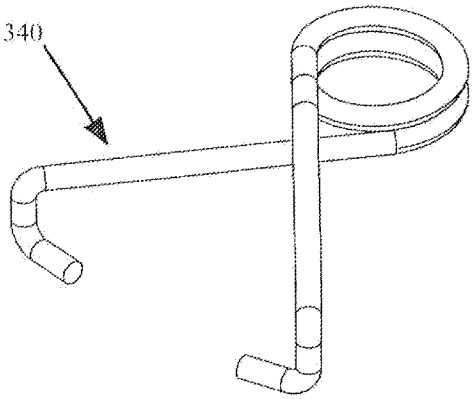
FIG. 34 is a perspective view of the torsion spring of the catch assembly of the release assembly of the second embodiment of the opening control device of the present invention.
Figure 37:
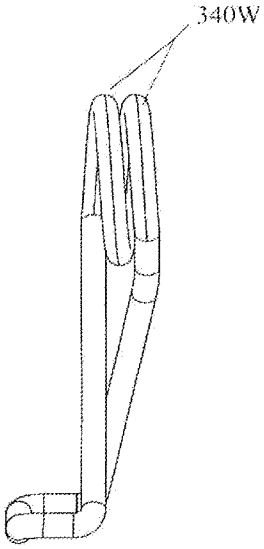
FIG. 37 is an end view of the torsion spring of FIG. 34.
Figure 36:
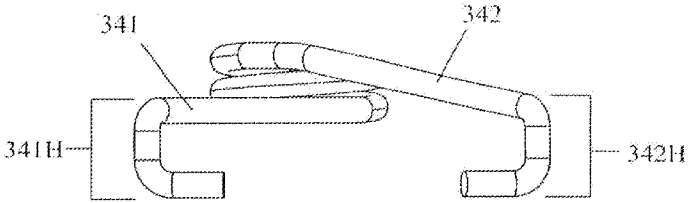
FIG. 36 is a side view of the torsion spring of FIG. 34.
Figure 35:
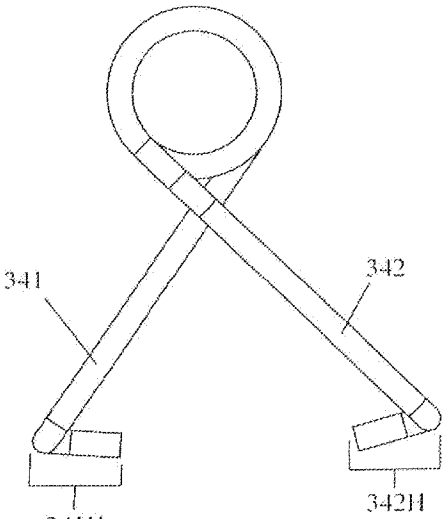
FIG. 35 is a front view of the torsion spring of FIG. 34.

The torsion spring 140 of FIG. 7 and FIGS. 11-11C may be replaced by torsion spring 340, which is shown in detail within FIGS. 34-37. Torsion spring 340 may include a small number of helical windings 340W that may terminate in a first leg 341 and a second leg 342. At the end of the first leg 341 being distal from the windings may be formed a hook portion 341H, and at the end of the second leg 342 may be formed a hook portion 342H. The first and second legs 341 and 342 may be used to bias the second arm 130 with respect to the first arm 120. However, with this arrangement, the bias that is applied by torsion spring 340 is applied directly to arms 120 and 130, whereas, for spring 140, the bias is applied through the rivet 150 and its connection to the first arm 120. As seen in FIG. 20, for catch assembly 101 and release assembly 201, the hook portion 341H of the first leg 341 of torsion spring 340 may wrap around the first arm 120, in proximity to its stop 125, while the hook portion 342H of the second leg 342 may wrap around the second arm 130. When the first arm 120 and second arm 130 are extended by opening of the sash, the torsion spring is elastically deformed, and as seen in FIG. 21, the first and second legs 341 and 342 of the spring 340 being so deformed apply a biasing force to the arms 120 and 130. Here again, once the release assembly 201 no longer has its hook secured within the opening 135 of the second arm, the spring 340 will bias the two arms to rotate toward each other until the side of the second arm contacts stop 125, as seen in FIG. 20.

For release assembly 201, the hook member used therein may take a slightly different shape, and a hook member 410, which is shown in detail within FIGS. 30-33, may be used instead of hook 210. Hook 410 may be formed similar to hook 210, but may have a hook portion 410C that is more rectangular in shape, and its return flange 414 may have a bent end flange 415 thereon, which may serve to more positively retain the hook in engagement with the switch member. The release assembly 201 may also use a base member 430 and a switch member 420, with the features of each being shown in detail within FIGS. 22-25, and FIGS. 26-29, respectively.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A device, for use in releasably limiting an amount of pivotal travel a sash window hingedly coupled to a window frame can be rotated open from a closed position, said device comprising:

a first arm having a first end and a second end, said first end configured to be pivotally mounted to the sash window;

a second arm having a first end and a second end, said first end of said second arm pivotally coupled to said second end of said first arm; said second end of said second arm comprising an opening configured to pass through said second arm, from a first side of said second arm to a second side of said second arm;

means for selective automatic repositioning of said first and second arms into a retracted position; and a release assembly comprising:

a hook member having a first end and a second end, said hook member comprising:

a hook at said first end of said hook member, and an opening at said second end of said hook member; said hook member configured to be pivotally received by the window frame to pivot between a first hook position and a second hook position; said hook in said first hook position configured to engage said opening in said second arm, when said second arm is in said retracted position and the sash window is rotated back into the closed position;

wherein when said hook member is pivoted into said second hook position, said hook is disengaged from said second arm, to permit said automatic repositioning of said first and second arms to said retracted position;

a safety button received in said opening in said hook member to be slidable between a first button position and a second button position, wherein said button in said first button position is configured to inhibit said pivotal movement of said hook member when said hook member is in said first hook position; said second button position configured to permit said hook member to pivot into said second hook position; and means for biasing said safety button to slide toward said first button position and simultaneously biasing said hook member to pivot toward said first hook position.

2. The device according to claim 1 wherein said opening in said second end of said second arm comprises a notch configured to accommodate said hook being disengaged from said second arm when said hook is pivoted into said second hook position.

3. A device, for use in releasably limiting an amount of pivotal travel a sash window hingedly coupled to a window frame can be rotated open from a closed position, said device comprising:

a first arm having a first end and a second end, said first end configured to be pivotally mounted to the sash window;

a second arm having a first end and a second end, said first end of said second arm pivotally coupled to said second end of said first arm; said second end of said second arm comprising an opening configured to pass through said second arm, from a first side of said second arm to a second side of said second arm;

means for selective automatic repositioning of said first and second arms into a retracted position; and a release assembly comprising:

a hook member having a first end and a second end, said hook member comprising:

a hook at said first end of said hook member, and an opening at said second end of said hook member; said hook member configured to be movably received by the window frame to move between a first hook position and a second hook position; said hook in said first hook position configured to engage said opening at said second end of said second arm, when said second arm is in said retracted position and the sash window is rotated back into the closed position;

wherein when said hook member is pivoted into said second hook position, said hook is disengaged from said opening at said second end of said second arm, to permit said automatic repositioning of said first and second arms to said retracted position;

a safety button received in said opening in said hook member to be movable between a first button position and a second button position, wherein said button in said first button position is configured to inhibit said movement of said hook member when said hook member is in said first hook position; said second button position configured to permit said hook member to move into said second hook position; and a spring configured to bias said safety button to slide toward said first button position and simultaneously bias said hook member to pivot toward said first hook position.

4. The device according to claim 3 wherein said opening in said second end of said second arm comprises a notch configured to accommodate said book being disengaged from said second arm when said hook is pivoted into said second hook position.

* * * * *